US008749591B2

(12) United States Patent
Baba et al.

(10) Patent No.: US 8,749,591 B2
(45) Date of Patent: Jun. 10, 2014

(54) IMAGE PROCESSING APPARATUS, IMAGE PROCESSING METHOD, AND IMAGE DISPLAY DEVICE

(75) Inventors: Masahiro Baba, Yokohama (JP); Ryosuke Nonaka, Kawasaki (JP); Yuma Sano, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 619 days.

(21) Appl. No.: 12/556,610

(22) Filed: Sep. 10, 2009

(65) Prior Publication Data

US 2010/0149224 A1 Jun. 17, 2010

(30) Foreign Application Priority Data

Dec. 17, 2008 (JP) ..... 2008-321104

(51) Int. Cl.
*G09G 5/10* (2006.01)

(52) U.S. Cl.
USPC ..... 345/690; 345/87; 345/88; 345/89; 345/102

(58) Field of Classification Search
None
See application file for complete search history.

(56) References Cited

U.S. PATENT DOCUMENTS

2009/0052774 A1* 2/2009 Yoshii et al. ..... 382/167

FOREIGN PATENT DOCUMENTS

| | | | |
|---|---|---|---|
| JP | 09-198000 | 7/1997 | |
| JP | 2002-262130 | 9/2002 | |
| JP | 2007-072115 | 3/2007 | |
| JP | 2007-233012 | 9/2007 | |
| JP | 2008-268642 | 6/2008 | |
| JP | 2008-203308 | 9/2008 | |
| JP | 2008-242330 | 10/2008 | |
| JP | 2008-301489 | 12/2008 | |
| WO | WO/2006/103835 | * 5/2006 | ..... H04N 9/68 |

OTHER PUBLICATIONS

Japanese Office Action for Japanese Application No. 2008-321104 mailed on Nov. 2, 2012.
Translation of Official Action of Notification of Reason for Rejection for Japanese Patent Application No. 2008-321104 Dated Feb. 22, 2013, 4 pgs.

* cited by examiner

*Primary Examiner* — Joseph Haley
*Assistant Examiner* — Ifedayo Iluyomade
(74) *Attorney, Agent, or Firm* — Amin, Turocy & Watson, LLP

(57) ABSTRACT

An image processing apparatus has a light source luminance calculating unit which calculates the luminances of the light sources of the plurality of colors of a back light based on an input image, a light source maximum value detecting unit which detects a light source maximum value that is the largest value in the light source luminances of the plurality of colors, a light source luminance correcting unit which corrects the light source luminances to obtain corrected light source luminances so as to reduce the difference among the light source luminances of the plurality of colors if the light source maximum value is smaller than a threshold value, a gradation conversion function calculating unit which calculates a gradation conversion function applied to the input image corresponding to each of the plurality of colors, by using the corrected light source luminance, and a control unit which converts the input image by using the gradation conversion function and outputs the input image to a liquid crystal panel and generates the luminance control signal by using the corrected light source luminance and outputs the luminance control signal to the back light.

17 Claims, 16 Drawing Sheets

IMAGE PROCESSING APPARATUS, IMAGE PROCESSING METHOD, AND IMAGE DISPLAY DEVICE

CROSS REFERENCE TO RELATED APPLICATION

This application is based upon and claims benefit of priority from the Japanese Patent Application No. 2008-321104, filed on Dec. 17, 2008, the entire contents of which are incorporated herein by reference.

BACKGROUND OF THE INVENTION

The present invention relates to an image processing apparatus, an image processing method, and an image display device.

Recently, there is a widespread use of an image display device, such as a liquid crystal display device, comprising a light source and a light modulation device which modulates a light intensity from the light source. However, in the prior art image display device, the light modulation device does not have ideal modulation characteristics, and therefore, especially when black is displayed, a light leakage from the light modulation device causes reduction in contrast. Further, since the light source emits light also when black is displayed, it is difficult to reduce power consumption.

In order to solve the above problem, according to an input image, there has been proposed to perform luminance modulation of light sources of a plurality of colors corresponding to, for example, three primary colors in combination with conversion of gradation of each pixel of the input image, that is, gamma conversion.

For example, there has been known a liquid crystal display device in which the maximum and minimum values of each of red, green and blue luminance levels are detected from the input image, amplification is performed so that the maximum amplitude (a difference between the maximum value and the minimum value) of the input image is equivalent to a dynamic range width of the liquid crystal device, and the light source luminance is set based on the maximum value of the luminance level of each color (for example, see, JP-A 2007-233012 (KOKAI), JP-A 2007-72115 (KOKAI)). In the above mentioned liquid crystal display device, compared with a display device with a constant light source luminance, the contrast can be increased. Further, since the light source luminance can be reduced according to the input image, the power consumption can be reduced.

In the above prior art display device, when emitting light in a color close to an achromatic color, for example when the light source luminance is set to be lowered, the color of the displayed image is changed due to the influence of quantization error of control of the light source luminance or quantization error of gradation conversion of the input image.

In general, there has been known that human perception to luminance is approximately proportionate to the luminance to the one-third power. Namely, although the amount of variation of the luminance is the same in the low and high luminances, the variation of lightness perceived by human in the low luminance is larger than that in the high luminance. Therefore, there has been a problem that a change of color of a displayed image in the low luminance is easily perceived by human.

SUMMARY OF THE INVENTION

According to one aspect of the present invention, there is provided an apparatus for processing image to supply a luminance control signal to light sources corresponding to a plurality of colors, and to supply a conversion image to a light modulation device which modulates a transmittance or a reflectance of lights emitted from the light sources, comprising:

a luminance calculating unit configured to calculate luminances of the light sources by using an input image;

a maximum value detecting unit configured to detect a maximum value that is the largest value in the luminances of the plurality of colors;

a luminance correcting unit configured to correct the luminances to obtain corrected luminances so as to reduce a difference among the luminances of the plurality of colors, if the maximum value is smaller than a predetermined threshold value;

a function calculating unit configured to calculate a gradation conversion function applied to the input image corresponding to each of the plurality of colors, by using the corrected luminances; and a control unit configured to convert the input image into the conversion image by using the gradation conversion function, configured to supply the conversion image to the modulation device, and configured to generate the luminance control signal by using the corrected luminance.

Further, the present invention provides a method for processing image by such an image processing apparatus.

According to one aspect of the present invention, there is provided an apparatus for processing image to supply luminance control signals to light sources corresponding to a plurality of colors and a plurality of divisional regions, and to supply a conversion image to a light modulation device which modulates a transmittance or a reflectance of lights emitted from the light sources, comprising:

a luminance calculating unit configured to calculate luminances of the light sources for each of the plurality of divisional regions by using an input image;

a maximum value detecting unit configured to detect a maximum value that is the largest value in the luminances of the plurality of colors, for each of the plurality of divisional regions;

a luminance correcting unit configured to, for each of the plurality of divisional regions, correct the luminances to obtain corrected luminances so as to reduce the difference among the luminances of the plurality of colors, if the maximum value is smaller than a predetermined threshold value;

a luminance distribution calculating unit configured to, for each of the plurality of divisional regions, calculate luminance distribution in the light sources by using the corrected luminances;

a function calculating unit configured to, for each of the plurality of divisional regions, calculate a gradation conversion function applied to the input image corresponding to each of the plurality of colors, by using the luminance distribution; and a control unit configured to convert the input image into the conversion image by using the gradation conversion function in each divisional region, configured to supply the conversion image to the modulation device, and configured to generate the luminance control signal by using the corrected luminance in each divisional region.

According to one aspect of the present invention, there is provided an image display device comprising:

a backlight configured to comprise light sources corresponding to a plurality of colors and a plurality of divisional regions, and configured to modulate luminances of the light sources by using a luminance control signal;

a liquid crystal panel configured to modulate a transmittance or a reflectance of lights emitted from the light sources by using a conversion image;

a luminance calculating unit configured to calculate luminances of the light sources for each of the plurality of divisional regions by using an input image;

a maximum value detecting unit configured to detect a maximum value that is the largest value in the luminances of the plurality of colors, for each of the plurality of divisional regions;

a luminance correcting unit configured to, for each of the plurality of divisional regions, correct the luminances to obtain corrected luminances so as to reduce the difference among the luminances of the plurality of colors, if the maximum value is smaller than a predetermined threshold value;

a luminance distribution calculating unit configured to, for each of the plurality of divisional regions, calculate luminance distribution in the light sources by using the corrected luminances;

a function calculating unit configured to, for each of the plurality of divisional regions, calculate a gradation conversion function applied to the input image corresponding to each of the plurality of colors, by using the luminance distribution; and a control unit configured to convert the input image into the conversion image by using the gradation conversion function in each divisional region, configured to supply the conversion image to the liquid crystal panel, and configured to generate the luminance control signal by using the corrected luminance in each divisional region.

DESCRIPTION OF THE EMBODIMENTS

Hereinafter, the embodiments of this invention will be described based on the drawings.

(First Embodiment)

Figure 1:
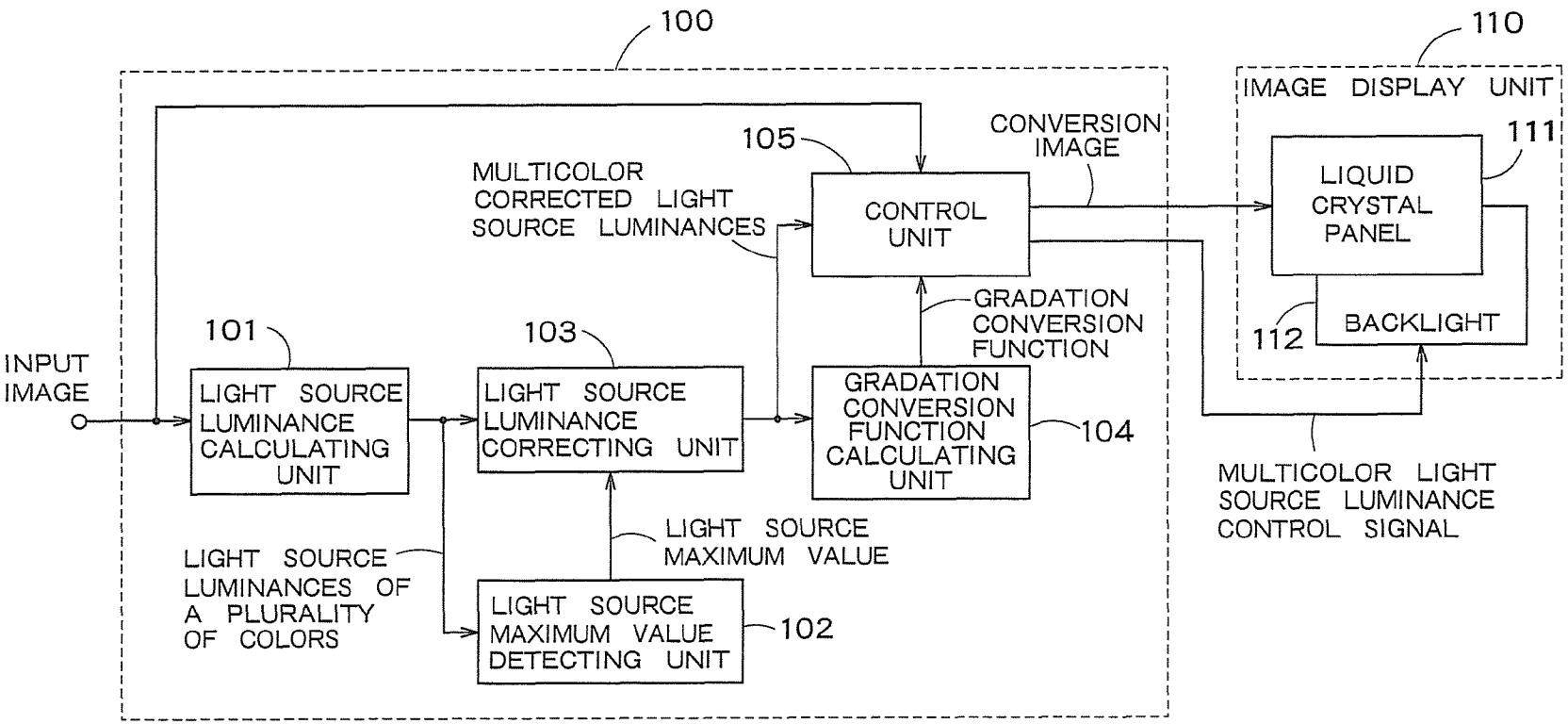
FIG. 1 is a schematic configuration diagram of an image processing apparatus according to a first embodiment.

FIG. 1 shows a schematic configuration of an image processing apparatus 100 according to a first embodiment of this invention. The image processing apparatus 100 comprises a light source luminance calculating unit 101, a light source maximum value detecting unit 102, a light source luminance correcting unit 103, a gradation conversion function calculating unit 104, and a control unit 105. The image processing apparatus 100 performs image display control of an image display unit 110.

The image display unit 110 is a liquid crystal display unit having a liquid crystal panel 111, which is a light modulation device, and a backlight 112 which is a light source unit of a plurality of colors provided on the back surface of the liquid crystal panel 111.

An input image given to the image processing apparatus 100 is input to the light source luminance calculating unit 101 and the control unit 105.

The light source luminance calculating unit 101 calculates light source luminances of a plurality of colors of the backlight 112 from the input image.

The present embodiment provides a constitution that the light sources of a plurality of colors have red, green, and blue light intensities that can be independently controlled, the red, green, and blue maximum gradations are detected from the input image, and the light source luminance of each color is calculated from the detected maximum gradations.

The light source luminance calculating unit 101 first detects the maximum gradation of each color from one frame of the input image. Next, the light source luminance calculating unit 101 calculates the maximum luminance value of each color from the detected maximum gradations.

For example, in an image with the input image expressed by 8 bits (0 gradation to 255 gradation), the maximum luminances $I_{Rmax}$, $I_{Gmax}$, and $I_{Bmax}$ can be analytically calculated from the red, green, and blue maximum gradations $L_{Rmax}$, $L_{Gmax}$, and $L_{Bmax}$ by the following Formula 1.

$$l_{R_{max}} = \left(\frac{L_{R_{max}}}{255}\right)^{\gamma}, \quad l_{G_{max}} = \left(\frac{L_{G_{max}}}{255}\right)^{\gamma}, \qquad \text{[Formula 1]}$$

-continued $$I_{B_{max}} = \left(\frac{L_{B_{max}}}{255}\right)^{\gamma}$$

In Formula 1, $\gamma$ represents a gamma value of the liquid crystal panel 111, and the value is normally 2.2.

At that time, the maximum luminances $I_{Rmax}$, $I_{Gmax}$, and $I_{Bmax}$ are 0 to 1 and relative values. For example, when the maximum gradation of a certain color is 202 gradation, the maximum luminance of the color is about 0.6 (=$(202/255)^{2.2}$). Namely, the luminance higher than 0.6 is not required to be displayed on the liquid crystal display unit 110. Thus, the light source luminance of the corresponding color is set to 0.6.

The light source luminance calculating unit 101 outputs the light source luminances of a plurality of colors, calculated as above, to the light source maximum value detecting unit 102 and the light source luminance correcting unit 103.

The light source maximum value detecting unit 102 detects the maximum value of the red, green, and blue light source luminances which are light sources of a plurality of colors. Namely, the light source maximum value detecting unit 102 compares the red, green, and blue light source luminances $I_{Rmax}$, $I_{Gmax}$, and $I_{Bmax}$ calculated by the light source luminance calculating unit 101 and detects the maximum value $I_{max}$. The light source maximum value detecting unit 102 outputs the detected maximum value, which is the light source maximum value, to the light source luminance correcting unit 103.

The light source luminance correcting unit 103 corrects the red, green, and blue light source luminances $I_{Rmax}$, $I_{Gmax}$, and $I_{Bmax}$, calculated by the light source luminance calculating unit 101, based on the light source maximum value $I_{max}$ and calculates (obtains) corrected light source luminances $I_{Rmax}'$, $I_{Gmax}'$, and $I_{Bmax}'$. The light source luminance correcting unit 103 performs correction so that the smaller the multicolor light source maximum value $I_{max}$, the smaller the difference of the red, green, and blue light source luminances $I_{Rmax}$, $I_{Gmax}$, and $I_{Bmax}$.

An example of the correction method is shown in the following Formula 2.

$$(I'_{Rmax}, I'_{Gmax}, I'_{Bmax}) = \begin{cases} (I_{max}, I_{max}, I_{max}) & I_{max} < T \\ (I_{Rmax}, I_{Gmax}, I_{Bmax}) & \text{otherwise} \end{cases} \quad \text{[Formula 2]}$$

Namely, when the multicolor light source maximum value $I_{max}$ is smaller than a predetermined threshold value T, the light source luminance correcting unit 103 determines that the lightness of the backlight 112 constituted of a multicolor light source is small. In order to prevent color change of the backlight 112, the light source luminance correcting unit 103 replaces each of the red, green, and blue light source luminances with the multicolor light source maximum value $I_{max}$ and performs conversion so that the red, green, and blue light source luminances are the same, that is, the light source color is achromatic color.

Meanwhile, when the multicolor light source maximum value $I_{max}$ is not less than the threshold value T, the red, green, and blue light source luminances are not changed, whereby $I_{Rmax}'=I_{Rmax}$, $I_{Gmax}'=I_{Gmax}$, and $I_{Bmax}'=I_{Bmax}$.

As described above, the light source luminance correcting unit 103 performs luminance correction so that when the light source maximum value $I_{max}$ is less than the predetermined threshold value, the light source color is the achromatic color.

Another example of the luminance correction method is hereinafter described. A correction ratio $\alpha(I_{max})$ is first calculated from the light source maximum value $I_{max}$ by a function shown in FIG. 2. The correction ratio is the minimum value of the ratio of the red, green, and blue light source luminances to the multicolor light source maximum value. For example when the correction ratio is 1, the red, green, and blue light source luminances with the ratio of less than 1 to the multicolor light source maximum value are corrected so that the ratio to the multicolor light source maximum value is 1. Namely, in the above case, each of the red, green, and blue light source luminances is corrected to the multicolor light source maximum value. Meanwhile, when the correction ratio is 0, the red, green, and blue light source luminances are not corrected. The above correction is expressed by the following Formula 3.

$$I'_{Rmax} = \begin{cases} \alpha(I_{max}) \cdot I_{max} & \frac{I_{Rmax}}{I_{max}} < \alpha(I_{max}) \\ I_{Rmax} & \text{otherwise} \end{cases} \quad \text{[Formula 3]}$$

$$I'_{Gmax} = \begin{cases} \alpha(I_{max}) \cdot I_{max} & \frac{I_{Gmax}}{I_{max}} < \alpha(I_{max}) \\ I_{Gmax} & \text{otherwise} \end{cases}$$

$$I'_{Bmax} = \begin{cases} \alpha(I_{max}) \cdot I_{max} & \frac{I_{Bmax}}{I_{max}} < \alpha(I_{max}) \\ I_{Bmax} & \text{otherwise} \end{cases}$$

Figure 2:
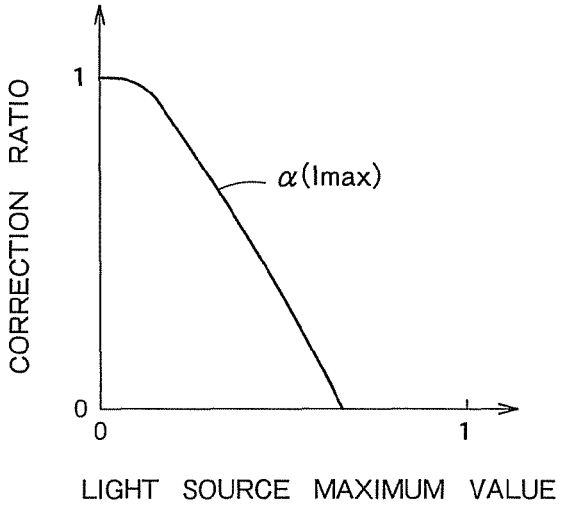
FIG. 2 is a graph showing a relation between a light source maximum value and a correction ratio.

Although, the correction function $\alpha(I_{max})$ shown in FIG. 2 is considered to be various functions, it is required to be a monotonically decreasing function to the multicolor light source maximum value $I_{max}$.

Although the correction function $\alpha(I_{max})$ may be calculated as a function by the light source luminance correcting unit 103, the correction function $\alpha(I_{max})$ may be previously calculated to be stored as a lookup table in, for example, ROM (Read Only Memory), and the lookup table is referred by the light source maximum value $I_{max}$, whereby the correction ratio $\alpha(I_{max})$ may be calculated.

The light source luminance correcting unit 103 outputs the red, green, and blue multicolor corrected light source luminances $I_{Rmax}'$, $I_{Gmax}'$, and $I_{Bmax}'$, calculated as above, to the gradation conversion function calculating unit 104 and the control unit 105.

The gradation conversion function calculating unit 104 calculates gradation conversion functions, which convert red, green, and blue images of the input image, based on the red, green, and blue multicolor corrected light source luminances.

Although there are considered various methods of calculating the gradation conversion function, the present embodiment provides a constitution that gains given to the red, green, and blue images of the input image are calculated so that the reduction of the red, green, and blue multicolor collected light source luminances $I_{Rmax}'$, $I_{Gmax}'$, and $I_{Bmax}'$ are compensated. The gains $G_R$, $G_G$, and $G_B$ given to the red, green, and blue images are calculated by the following Formula 4.

$$(G_R, G_G, G_B) = \left(\frac{1}{I'_{Rmax}}, \frac{1}{I'_{Gmax}} \frac{1}{I'_{Bmax}}\right) \quad \text{[Formula 4]}$$

For example, the red, green, and blue multicolor collected light source luminances $I_{Rmax}'$, $I_{Gmax}'$, and $I_{Bmax}'$ are respectively 0.2, 0.6, and 0.8, the gains $G_R$, $G_G$, and $G_B$ are respectively 5.0, 1.67, and 1.25.

In the present embodiment, each gain of the red, green, and blue images of the input image is calculated by using the Formula 4, however, for example, the relation between the light source luminance and the gain is previously obtained to be held as a lookup table in, for example, ROM, and the lookup table is referred by using the multicolor collected light source luminance, whereby the gain may be calculated.

In the control unit 105 to be described later, the gradation of each pixel of the input image is multiplied by a value obtained by raising the power of one by γ to the gain, whereby the conversion image is calculated. Thus, the relation of the light source luminance and the value obtained by raising the power of one by γ to the gain is previously obtained to be held as the lookup table in, for example, ROM. The lookup table is referred by using the multicolor collected light source luminance, whereby the gain to the power of one by γ may be calculated.

The gradation conversion function calculating unit 104 outputs the gradation conversion functions (gains), calculated as above and applied to the red, blue, and green images of the input image, to the control unit 105.

The control unit 105 performs the gradation conversion of the input image based on the gains set by the gradation conversion function calculating unit 104 and generates a conversion image. The control unit 105 further generates, based on the multicolor corrected light source luminances, a multicolor light source luminance control signal for making a plurality of colors of the light sources of the backlight 112 actually emit light. The control unit 105 controls the output timing to output the conversion image to the liquid crystal panel 111, and, thus, to output the multicolor light source luminance control signal to a plurality of colors of the light sources of the backlight 112.

First, a gradation conversion method is described. In the gradation conversion method of the present embodiment, based on the gains $G_R$, $G_G$, and $G_B$ calculated by the gradation conversion function calculating unit 104, the gradation of each of the red, green, and blue images of the input image is converted. The gradation conversion is performed by the following Formula 5.

$$L_{Rout}(x, y)=G_R^{1/\gamma}\cdot L_{Rin}(x, y)$$

$$L_{Gout}(x, y)=G_G^{1/\gamma}\cdot L_{Gin}(x, y)$$

$$L_{Bout}(x, y)=G_B^{1/\gamma}\cdot L_{Bin}(x, y) \quad \text{[Formula 5]}$$

In Formula 5, $L_{Rin}(x,y)$, $L_{Gin}(x,y)$, and $L_{Bin}(x,y)$ respectively represent red, green and blue gradations at a horizontal pixel position x and a vertical pixel position y of the input image. $L_{Rout}(x,y)$, $L_{Gout}(x,y)$, and $L_{Bout}(x,y)$ respectively represent the red, green and blue gradations at the horizontal pixel position x and the vertical pixel position y of the conversion image.

Next, a multicolor corrected light source luminance control signal is described. Although the multicolor corrected light source luminance control signal has a different constitution according to the kind of the light source, the light source of the backlight 112 generally used in a liquid crystal display device includes a cold-cathode fluorescent lamp and a light-emitting diode (LED). Their luminances can be modulated by control of voltage and current to be applied.

However, as a method of modulating the light source luminance, PWM (Pulse Width Modulation) control is generally used. In the PWM control, the luminance is modulated by switching an emission period and a non-emission period at a high speed. The PWM control will be described in detail later. The present embodiment provides a constitution that an LED light source in which the emission intensity is relatively easily controlled is used as a plurality of colors of the light sources of the backlight 112, and the LED light source is luminance-modulated by the PWM control.

Thus, the control unit 105 generates the multicolor corrected light source luminance control signal, which is a PWM control signal, based on the multicolor collected light source luminances $I_{Rmax}'$, $I_{Gmax}'$, $I_{Bmax}'$.

The control unit 105 supplies the conversion image, calculated by the above processing, to the liquid crystal panel 111 along with a control signal such as a horizontal synchronizing signal and a vertical synchronizing signal for driving the liquid crystal panel 111. The control unit 105 synchronizes with the output of the conversion image to the liquid crystal panel 111 to output the multicolor corrected light source luminance control signal to the backlight 112. The multicolor corrected light source luminance control signal controls the emission intensity of a plurality of colors of the light sources of the backlight 112.

In the image display unit 110, the conversion image is written in the liquid crystal panel 111, and a plurality of colors of the light sources of the backlight 112 are turned on based on the multicolor corrected light source luminance control signal, whereby an image is displayed.

Figure 3:
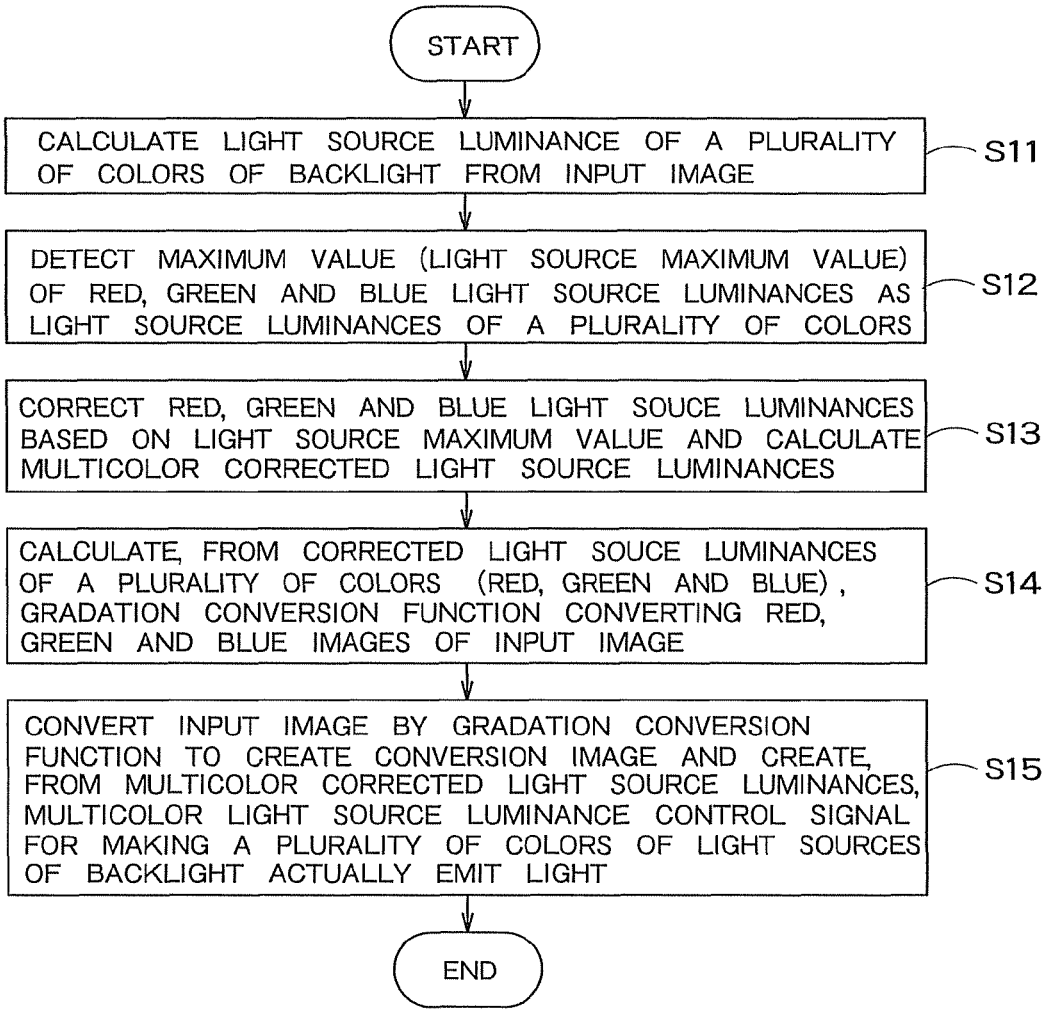
FIG. 3 is a flowchart for explaining an image processing method according to the first embodiment.

The method of processing the input image performed by the image processing apparatus 100 is described by using the flowchart of FIG. 3.

(Step S11) The light source luminance calculating unit 101 calculates a plurality of colors (red, green, and blue) of the light source luminances (the maximum luminance of the input image) $I_{Rmax}$, $I_{Gmax}$, and $I_{Bmax}$ of the backlight 112 from the input image.

(Step S12) The light source maximum value detecting unit 102 detects the maximum value $I_{max}$ from the light source luminances $I_{Rmax}$, $I_{Gmax}$, and $I_{Bmax}$ calculated in step S11.

(Step S13) The light source luminance correcting unit 103 compares the maximum value $I_{max}$ detected in step S12 with a predetermined threshold value to perform correction based on the comparison result so that the difference between the light source luminances $I_{Rmax}$, $I_{Gmax}$, and $I_{Bmax}$ is reduced, and, thus, to calculate the multicolor correction light source luminances $I_{Rmax}'$, $I_{Gmax}'$, and $I_{Bmax}'$. For example when the maximum value $I_{max}$ is less than the threshold value, the light source luminance correcting unit 103 performs the luminance correction so that $I_{Rmax}'=I_{Gmax}'=I_{Bmax}'=I_{max}$.

(Step S14) The gradation conversion function calculating unit 104 calculates the gains $G_R$, $G_G$, and $G_B$, given the red, green, and blue images, based on the multicolor corrected light source luminances $I_{Rmax}'$, $I_{Gmax}'$, and $I_{Bmax}'$ calculated in step S13.

(Step S15) The control unit 105 performs the gradation conversion of the input image by using the gains $G_R$, $G_G$, and $G_B$ calculated in step S14 and outputs the conversion image to the liquid crystal panel 111. The control unit 105 further generates the multicolor corrected light source luminance correction signal (PWM control signal) based on the multicolor corrected light source luminances $I_{Rmax}'$, $I_{Gmax}'$, and $I_{Bmax}'$ to output the PWM control signal to the backlight 112.

As described above, when the light source luminance of the backlight 112 is low, the luminance correction is performed so that the emission color of the light source approaches an achromatic color.

Figure 4:
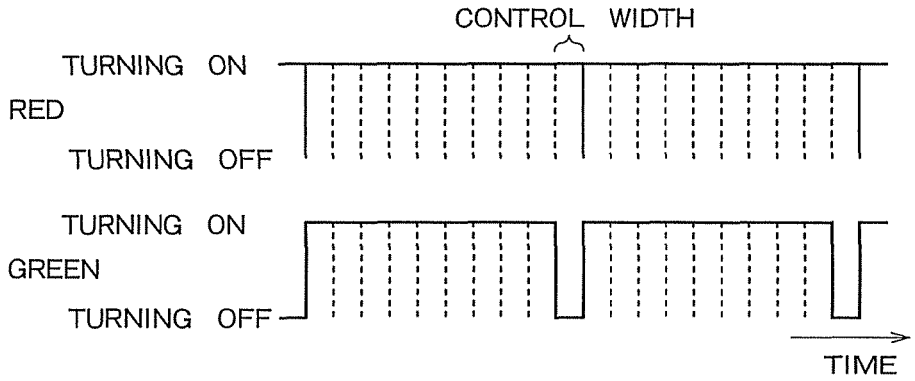
FIG. 4 is a view showing an example of PWM control in high luminance.
Figure 5:
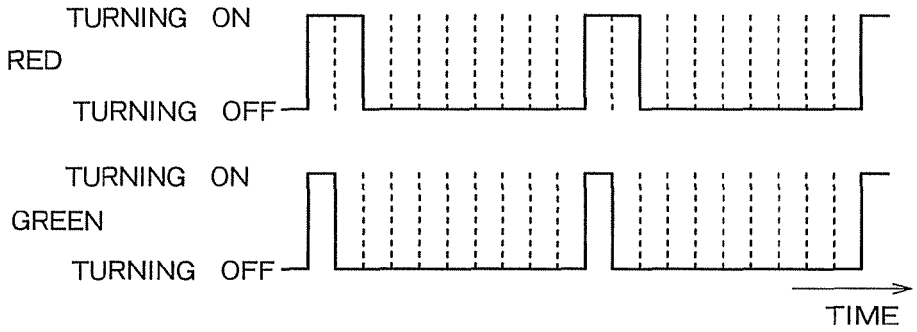
FIG. 5 is a view showing an example of PWM control in low luminance.

In the description of the effects of the present embodiment, the PWM control for controlling the light source luminance is first described. An example of the PWM control signal for controlling the red and green light source luminances is shown in FIGS. 4 and 5. The horizontal axis represents time, and the vertical axis represents emission (turning on)/non-emission non-emission (turning off). FIG. 4 shows the PWM control signal when the light source luminance is high, and FIG. 5 shows the PWM control signal when the light source luminance is low. For ease of explanation, 1 PWM period is assumed to be controlled in 10 control widths. Namely, the luminance is controlled at 10 steps.

As shown in FIG. 4, when the light source luminance is high, and the red light source always emits light, the green light source luminance is set to be lower by one step than the red light source luminance, whereby a green PWM control signal makes one control width non-emission. At that time, the emission period between red and green is 10:9, and the emission color of the backlight is controlled in units of 10%.

Meanwhile, as shown in FIG. 5, when the light source luminance is low, and, for example, the red light source emits light in 2 control width, the green light source luminance is set to be lower by one step than the red light source luminance, whereby the green PWM control signal makes one control width emission. At that time, the emission period between red and green is 2:1, and the emission color of the backlight is controlled in units of 50%.

Namely, the lower the light source luminance, the rougher the control of the emission color of the backlight. Thus, even when the light source luminances of a plurality of colors are calculated with high accuracy, a detailed control of a color is difficult in the low light source luminance, whereby the color of the displayed image is easily changed.

Further, when the light source luminance is low, the color control of the backlight light source is rough in accuracy in view of human luminosity factor. Hereinafter, the reason will be described.

Figure 6:
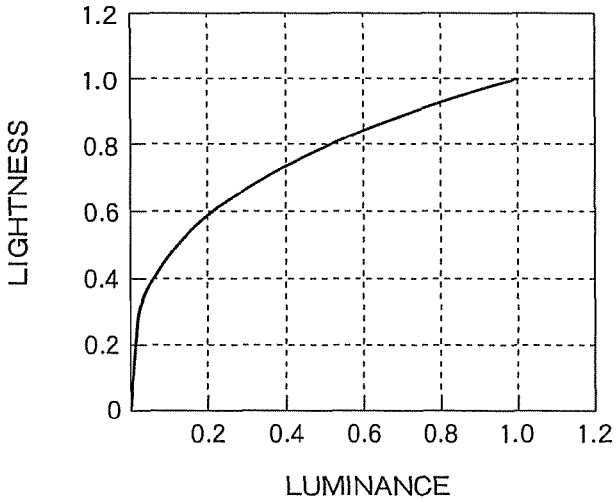
FIG. 6 is a graph showing a relation between luminance and lightness.

There has been known that human perception to luminance is approximately proportionate to the luminance to the one-third power, and the human perception is defined as lightness. The relation between the luminance and the lightness is shown in FIG. 6. Based on FIG. 6, it is found that the variation amount of the lightness to the variation of the luminance in the low luminance is larger than the variation amount of the lightness to the variation of the luminance in the high luminance. Namely, although the variation amount is the same in the low and high luminances, the variation amount of the lightness perceived by human in the low luminance is larger than that in the high luminance.

Meanwhile, the light source luminance is controlled by the PWM control and linearly controlled by the luminance. Therefore, the accuracy of the lightness perceived by human in the low lightness is rough, and the change of the color of the displayed image is easily perceived.

Therefore, in the present embodiment, the light source luminances of a plurality of colors are corrected so that as the light source luminance of the backlight becomes lower, the emission color of the light source approaches the achromatic color, that is, so that the difference between the light source luminances of a plurality of colors is reduced, and the change of the color of the displayed image is reduced.

Figure 7:
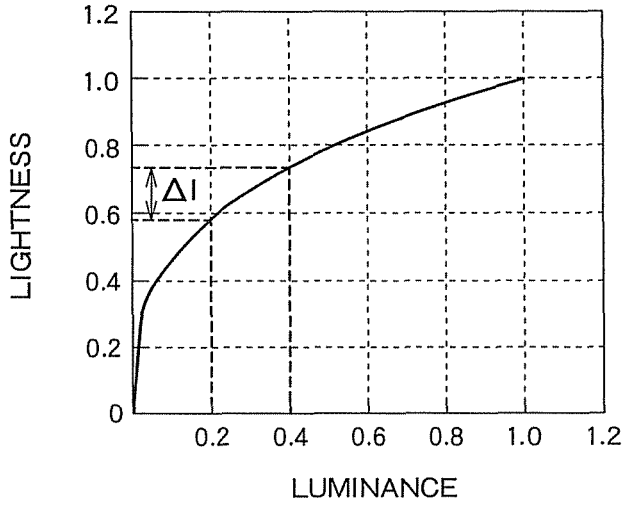
FIG. 7 is a graph showing an example of a lightness variation amount against luminance variation.

At that time, the correction amount that should reduce the difference can be obtained from the following viewpoint. For example, when the PWM control signal controlling the luminance of the backlight light source can be changed at 5 steps, that is, can be changed for every 0.2, as shown in FIG. 7, the difference ΔI between the lightness to the luminance of 0.2 and the lightness to the luminance of 0.4 is about 0.15.

Figure 8:
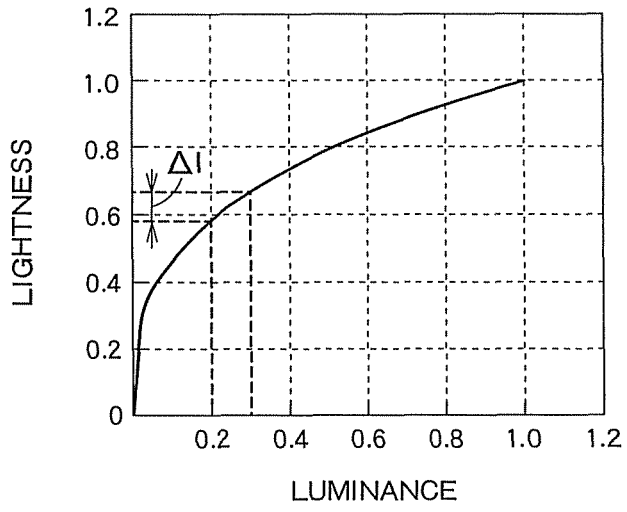
FIG. 8 is a graph showing an example of a lightness variation amount against luminance variation.

Meanwhile, when the PWM control signal can be changed at 10 steps, that is, can be changed for every 0.1, as shown in FIG. 8, the difference ΔI between the lightness to the luminance of 0.2 and the lightness to the luminance of 0.3 is about 0.08.

Namely, as the control width of the PWM control signal becomes smaller, the lightness variation can be reduced, and the correction amount of the luminance is determined so that the lightness variation ΔI at that time is such an amount that the change of the color is not visually confirmed or is allowable.

For example, when ΔI of FIG. 8 is an allowable lightness variation, the light source luminance is corrected to be the achromatic color when the light source luminance is less than 0.2. In FIG. 7, when the light source luminance is changed from 0.4 to 0.6, ΔI of FIG. 7 is comparable with ΔI of FIG. 8, and therefore, the light source luminance is corrected to be the achromatic color when the light source luminance is less than 0.4.

More specifically, it is experimentally confirmed that the threshold value T of the formula 2 is preferably set between 0.05 and 0.4.

As described above, in the present embodiment, the difference between the luminances of a plurality of colors is reduced in the low luminance, and the light source color approaches the achromatic color, whereby it is possible to prevent the color of the displayed image from being changed when the multicolor light source luminances of the backlight are controlled, and visual contrast of the displayed image can be increased. At the same time, the power consumption can be reduced.

(Second Embodiment)

Figure 9:
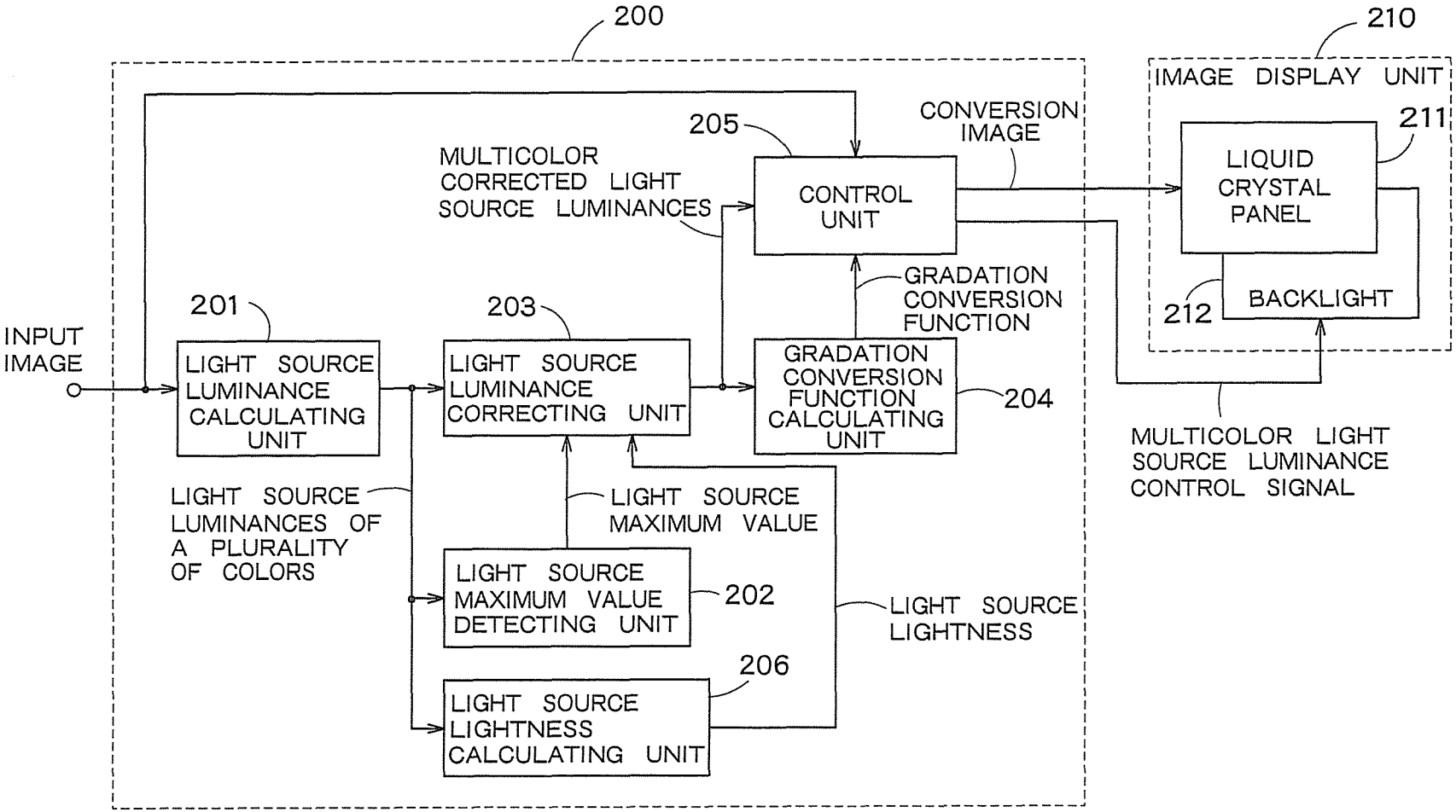
FIG. 9 is a schematic configuration diagram of an image processing apparatus according to a second embodiment.

FIG. 9 shows a schematic configuration of an image processing apparatus 200 according to the second embodiment of this invention. The image processing apparatus 200 comprises a light source luminance calculating unit 201, a light source maximum value detecting unit 202, a light source luminance correcting unit 203, a gradation conversion function calculating unit 204, a control unit 205, and a light source lightness calculating unit 206. The image processing apparatus 200 performs image display control of an image display unit 210.

The image display unit 210 is a liquid crystal display unit having a liquid crystal panel 211, which is a light modulation device, and a backlight 212 which is a plurality of colors of a light source unit provided on the back surface of the liquid crystal panel 211.

The light source luminance calculating unit 201, the light source maximum value detecting unit 202, the gradation conversion function calculating unit 204, the control unit 205, and the image display unit 210 are similar to the light source luminance calculating unit 101, the light source maximum value detecting unit 102, the gradation conversion function calculating unit 104, the control unit 105, and the image display unit 110 of the first embodiment, and thus the description will be omitted.

A light source lightness calculating unit 206 calculates the lightness from the multicolor light source luminances obtained by the light source luminance calculating unit 201. The lightness is a lightness in any one of the color spaces of CIELAB, CIELUV, LCh, HSI, and HSL.

For example, when a plurality of colors of the light sources of the backlight 212 can emit red, green, and blue lights, a light source luminance Y is calculated by the following Formula 6 from the red, green, and blue light source luminances $I_{Rmax}$, $I_{Gmax}$, and $I_{Bmax}$ having a value from 0 (minimum) to 1

(maximum) calculated by the light source luminance calculating unit 201.

$$Y=a_R \cdot l_{Rmax}+a_G \cdot l_{Gmax}+a_B \cdot l_{Bmax} \quad \text{[Formula 6]}$$

In Formula 6, $a_R$, $a_G$, and $a_B$ are coefficients determined by red, green, and blue spectral characteristics. $a_R$, $a_G$, and $a_B$ are normalized so that the sum of them is 1. Next, a lightness L* is calculated from the light source luminance Y by the following Formula 7.

$$L^* = \begin{cases} 116Y^{1/3} - 16 & Y > 0.008856 \\ 903.3Y & \text{otherwise} \end{cases} \quad \text{[Formula 7]}$$

The lightness normalized by CIE (International Commission on Illumination) is calculated by the Formula 7, however, for example, for ease of processing, the lightness may be calculated by the following Formula 8.

$$L^*=100Y^{1/3} \quad \text{[Formula 8]}$$

The light source lightness calculating unit 206 outputs, as the light source lightness, the lightness L*, calculated as above, to the light source luminance correcting unit 203.

The light source luminance correcting unit 203 corrects the red, green, and blue light source luminances $I_{Rmax}$, $I_{Gmax}$, and $I_{Bmax}$, calculated by the light source luminance calculating unit 201, based on the light source lightness L* and calculates the corrected light source luminances $I_{Rmax}'$, $I_{Gmax}'$, and $I_{Bmax}'$.

The light source luminance correcting unit 203 performs correction so that the smaller the light source lightness L*, the smaller the difference between the red, green, and blue light source luminances. An example of the specific configuration of the operation is shown in the following Formula 9.

$$(l'_{Rmax}, l'_{Gmax}, l'_{Bmax}) = \begin{cases} (l_{max}, l_{max}, l_{max}) & L^* < T \\ (l_{Rmax}, l_{Gmax}, l_{Bmax}) & \text{otherwise} \end{cases} \quad \text{[Formula 9]}$$

As shown in the Formula 9, when the light source lightness L* is smaller than the predetermined threshold value T, it is determined that the lightness of the backlight 212 constituted of a plurality of colors of the light sources is small. In order to prevent the color change of the backlight 212, each of the red, green, and blue light source luminances is replaced with the light source maximum value $I_{max}$ to be converted to be the same as each other, that is, converted to be the achromatic color.

A variation of the luminance correcting method is shown as follows. First, a correction ratio β(L*) is calculated from the light source lightness L* by the function shown in FIG. 10. The correction ratio is the minimum value of the ratio of each of the red, green, and blue light source luminances to the light source maximum value $I_{max}$. For example, when the correction ratio is 1, the red, green, and blue light source luminances with the ratio of less than 1 to the light source maximum value $I_{max}$ are corrected so that the ratio to the light source maximum value $I_{max}$ is 1. Namely, in the above case, each of the red, green, and blue light source luminances is corrected to the light source maximum value $I_{max}$. Meanwhile, when the correction ratio is 0, the red, green, and blue light source luminances are not corrected. The correction is represented by the following Formula 10.

$$l'_{Rmax} = \begin{cases} \beta(L^*) \cdot l_{max} & \frac{l_{Rmax}}{l_{max}} < \beta(L^*) \\ l_{Rmax} & \text{otherwise} \end{cases} \quad \text{[Formula 10]}$$

$$l'_{Gmax} = \begin{cases} \beta(L^*) \cdot l_{max} & \frac{l_{Gmax}}{l_{max}} < \beta(L^*) \\ l_{Gmax} & \text{otherwise} \end{cases}$$

$$l'_{Bmax} = \begin{cases} \beta(L^*) \cdot l_{max} & \frac{l_{Bmax}}{l_{max}} < \beta(L^*) \\ l_{Bmax} & \text{otherwise} \end{cases}$$

Figure 10:
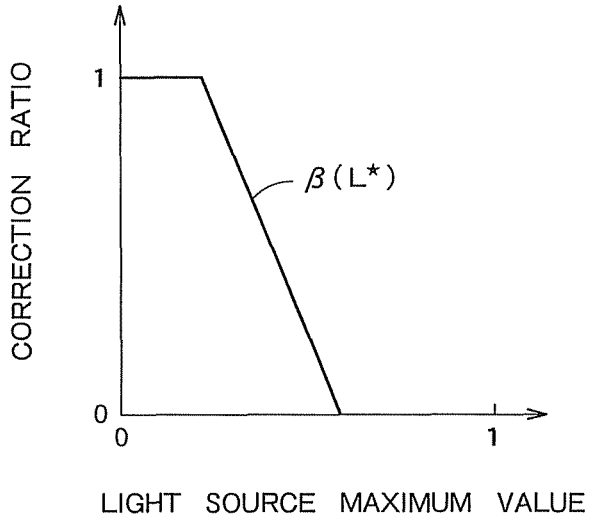
FIG. 10 is a graph showing a relation between the lightness and the correction ratio.

Although the correction function β(L*) shown in FIG. 10 is considered to be various functions, it is required to be a monotonically decreasing function to the multicolor light source lightness. The correction function β(L*) may be calculated as a function by the light source luminance correcting unit 203; however, the correction function β(L*) may be previously calculated to be held as a lookup table in, for example, ROM, and the lookup table is referred by using the light source lightness L*, whereby the correction ratio β(L*) may be calculated.

The light source luminance correcting unit 203 outputs the red, green, and blue multicolor corrected light source luminances $I_{Rmax}'$, $I_{Gmax}'$, and $I_{Bmax}'$, calculated as above, to the gradation conversion function calculating unit 204 and the control unit 205.

In the present embodiment, because the lightness L* is calculated, the processing amount is larger than the processing amount of the first embodiment. However, since the luminance correction based on the lightness is performed considering the human perception to luminance, the luminance correction with higher accuracy can be realized.

In the present embodiment, the difference between the luminances of a plurality of colors is reduced in the low lightness, and the light source color approaches the achromatic color, whereby it is possible to prevent the color of the displayed image from being changed when the multicolor light source luminances of the backlight are controlled, and the visual contrast of the displayed image can be increased. At the same time, the power consumption can be reduced.

(Third Embodiment)

Figure 11:
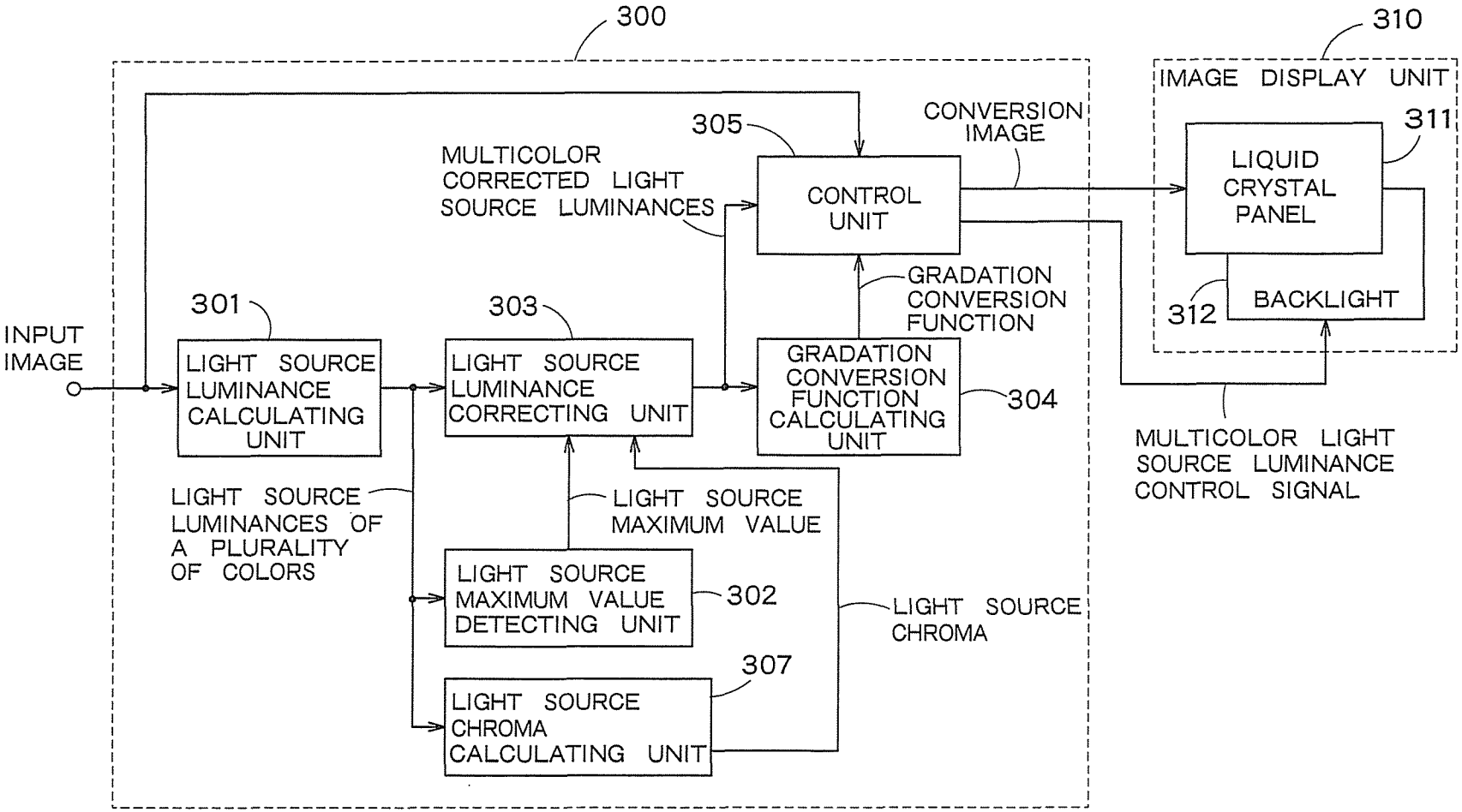
FIG. 11 is a schematic configuration diagram of an image processing apparatus according to a third embodiment.

FIG. 11 shows a schematic configuration of an image processing apparatus 300 according to the third embodiment of this invention. The image processing apparatus 300 comprises a light source luminance calculating unit 301, a light source maximum value detecting unit 302, a light source luminance correcting unit 303, a gradation conversion function calculating unit 304, a control unit 305, and a light source chroma calculating unit 307. The image processing apparatus 300 performs image display control of an image display unit 310.

The image display unit 310 is a liquid crystal display unit having a liquid crystal panel 311, which is a light modulation device, and a backlight 312 which is a plurality of colors of a light source unit provided on the back surface of the liquid crystal panel 311.

The light source luminance calculating unit 301, the light source maximum value detecting unit 302, the gradation conversion function calculating unit 304, the control unit 305, and the image display unit 310 are similar to the light source luminance calculating unit 101, the light source maximum value detecting unit 102, the gradation conversion function calculating unit 104, the control unit 105, and the image display unit 110 of the first embodiment, and thus the description will be omitted.

The light source chroma calculating unit 307 calculates a chroma from the light source luminance obtained by the light source luminance calculating unit 301. The chroma is a chroma in any one of the color spaces of CIELAB, CIELUV, LCh, HSI, and HSL.

For example, when a plurality of colors of the light sources of the backlight 312 can emit red, green, and blue lights, the light source chroma calculating unit 307 calculates tristimulus values X, Y, and Z of the light source by the following Formula 11 from the red, green, and blue light source luminances $I_{Rmax}$, $I_{Gmax}$, and $I_{Bmax}$ having a value from 0 (minimum) to 1 (maximum) calculated by the light source luminance calculating unit 301.

$$\begin{bmatrix} X \\ Y \\ Z \end{bmatrix} = M \begin{bmatrix} l_{Rmax} \\ l_{Gmax} \\ l_{Bmax} \end{bmatrix} \quad \text{[Formula 11]}$$

In Formula 11, M is a matrix of 3×3 determined by the red, green, and blue spectral characteristics. M is normalized so that when $I_{Rmax}$, $I_{Gmax}$, and $I_{Bmax}$ are maximum, that is, all of them are 1, Y is 1. Next, the light source chroma calculating unit 307 calculates a* and b* representing colors by the following Formula 12 with the use of the tristimulus values X, Y, and Z.

$$a^*=500\{f(X/X_W)-f(Y/Y_W)\}$$

$$b^*=200\{f(Y/Y_W)-f(Z/Z_W)\} \quad \text{[Formula 12]}$$

In Formula 12, $X_W$, $Y_W$, and $Z_W$ represent the tristimulus values when $I_{Rmax}$, $I_{Gmax}$, and $I_{Bmax}$ are maximum, that is, all of them are 1. The function f(x) is represented as the following Formula 13.

$$f(x) = \begin{cases} x^{1/3} & x > 0.008856 \\ 7.787x + 16/116 & \text{otherwise} \end{cases} \quad \text{[Formula 13]}$$

a* and b* calculated by the Formula 12 are a coordinate of the color space using a three-dimensional orthogonal coordinate system called the CIELAB color space. The light source chroma calculating unit 307 calculates a chroma C by the following Formula 14 with the use of a* and b*.

$$C=\{(a^*)^2+(b^*)^2\}^{1/2} \quad \text{[Formula 14]}$$

The light source chroma calculating unit 307 outputs, as a light source chroma, the chroma C, calculated as above, to the light source luminance correcting unit 303.

The light source luminance correcting unit 303 corrects the red, green, and blue light source luminances, calculated by the light source luminance calculating unit 301, based on the light source chroma to calculate the multicolor corrected light source luminances.

The light source luminance correcting unit 303 performs correction so that the smaller the light source chroma, the smaller the difference between the red, green, and blue light source luminances. An example of the specific configuration of the operation is shown in the following Formula 15.

$$(l'_{Rmax}, l'_{Gmax}, l'_{Bmax}) = \begin{cases} (l_{max}, l_{max}, l_{max},) & C < T \\ (l_{Rmax}, l_{Gmax}, l_{Bmax}) & \text{otherwise} \end{cases} \quad \text{[Formula 15]}$$

As shown in the Formula 15, when the light source chroma C is smaller than a predetermined threshold value T, it is determined that the chroma of the backlight 312 constituted of a plurality of colors of the light sources is small. In order to prevent the color change of the backlight 312, each of the red, green, and blue light source luminances $I_{Rmax}$, $I_{Gmax}$, and $I_{Bmax}$ is replaced with the light source maximum value $I_{max}$ to be converted to be the same as each other, that is, converted to be the achromatic color.

A variation of the correcting method is shown as follows. First, a correction ratio χ(C) is calculated based on the light source chroma C by the function shown in FIG. 12. The correction ratio is the minimum value of the ratio of each of the red, green, and blue light source luminances to the light source maximum value $I_{max}$.

For example, when the correction ratio is 1, the red, green, and blue light source luminances with the ratio of less than 1 to the light source maximum value are corrected so that the ratio to the light source maximum value $I_{max}$ is 1. Namely, in the above case, each of the red, green, and blue light source luminances is corrected to the light source maximum value $I_{max}$. Meanwhile, when the correction ratio is 0, the red, green, and blue light source luminances are not corrected. The correction is represented by the following Formula 16.

$$l'_{Rmax} = \begin{cases} \chi(C)\cdot l_{max} & \frac{l_{Rmax}}{l_{max}} < \chi(C) \\ l_{Rmax} & \text{otherwise} \end{cases} \quad \text{[Formula 16]}$$

$$l'_{Gmax} = \begin{cases} \chi(C)\cdot l_{max} & \frac{l_{Gmax}}{l_{max}} < \chi(C) \\ l_{G\,max} & \text{otherwise} \end{cases}$$

$$l'_{Bmax} = \begin{cases} \chi(C)\cdot l_{max} & \frac{l_{Bmax}}{l_{max}} < \chi(C) \\ l_{Bmax} & \text{otherwise} \end{cases}$$

Figure 12:
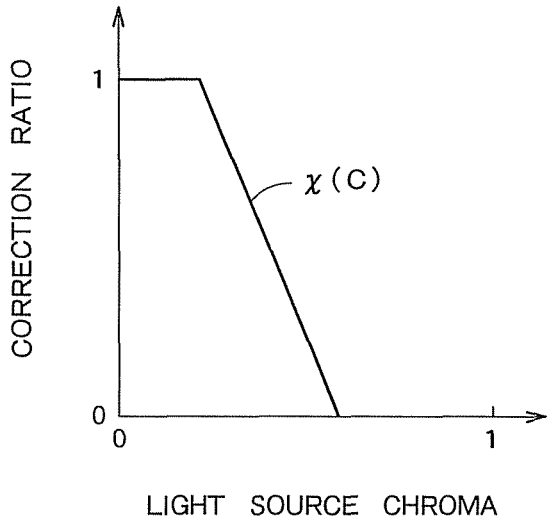
FIG. 12 is a graph showing a relation between a chroma and the correction ratio.

Although the correction function χ(C) shown in FIG. 12 is considered to be various functions, it is required to be a monotonically decreasing function to the light source chroma C. The correction function χ(C) may be calculated as a function by the light source luminance correcting unit 303; however, the correction function χ(C) may be previously calculated to be held as a lookup table in, for example, ROM, and the lookup table is referred by using the light source chroma C, whereby the correction function χ(C) may be calculated.

The light source luminance correcting unit 303 outputs the red, green, and blue multicolor corrected light source luminances $I_{Rmax}'$, $I_{Gmax}'$, and $I_{Bmax}'$, calculated as above, to the gradation conversion function calculating unit 304 and the control unit 305.

In the present embodiment, the chroma C is calculated from the light source luminance, and the light source luminance is corrected based on the chroma C. A human is sensitive to a change from achromatic color to chromatic color, and therefore, the chroma C is calculated, and, when the light source color is close to the achromatic color, the light source color is corrected to the achromatic color, whereby the change of color of the displayed image perceived by the human can be prevented.

In the present embodiment, the difference between the luminances of a plurality of colors is reduced in the low chroma, and the light source color approaches the achromatic color, whereby it is possible to prevent the color of the displayed image from being changed when the multicolor light source luminances of the backlight are controlled, and the visual contrast of the displayed image can be increased. At the same time, the power consumption can be reduced.

(Fourth Embodiment)

Figure 13:
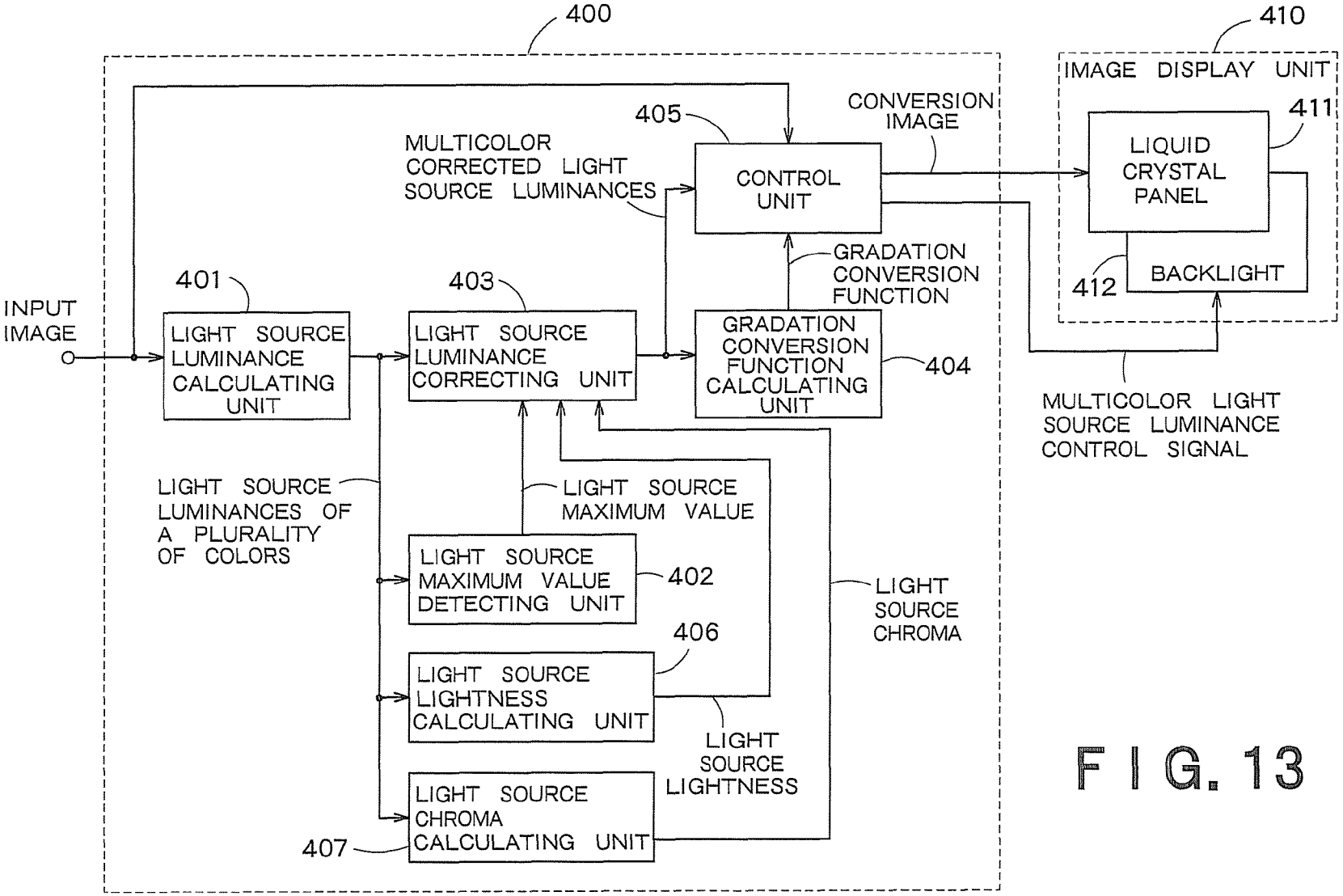
FIG. 13 is a schematic configuration diagram of an image processing apparatus according to a fourth embodiment.

FIG. 13 shows a schematic configuration of an image processing apparatus 400 according to the fourth embodiment of this invention. The image processing apparatus 400 comprises a light source luminance calculating unit 401, a light source maximum value detecting unit 402, a light source luminance correcting unit 403, a gradation conversion function calculating unit 404, a control unit 405, a light source lightness calculating unit 406, and a light source chroma calculating unit 407. The image processing apparatus 400 performs image display control of an image display unit 410.

The image display unit 410 is a liquid crystal display unit having a liquid crystal panel 411, which is a light modulation device, and a backlight 412 which is a plurality of colors of a light source unit provided on the back surface of the liquid crystal panel 411.

The light source luminance calculating unit 401, the light source maximum value detecting unit 402, the gradation conversion function calculating unit 404, the control unit 405, and the image display unit 410 are similar to the light source luminance calculating unit 101, the light source maximum value detecting unit 102, the gradation conversion function calculating unit 104, the control unit 105, and the image display unit 110 of the first embodiment, and thus the description will be omitted. The light source lightness calculating unit 406 is similar to the light source lightness calculating unit 206 of the second embodiment, and the light source chroma calculating unit 407 is similar to the light source chroma calculating unit 307 of the third embodiment; thus, the description will be omitted.

The light source luminance correcting unit 403 corrects the red, green, and blue light source luminances, calculated by the light source luminance calculating unit 401, based on the light source lightness L* calculated by the light source lightness calculating unit 406 and the light source chroma C calculated by the light source chroma calculating unit 407 and calculates the multicolor corrected light source luminances.

The light source luminance correcting unit 403 performs correction so that the smaller the light source lightness L* and the chroma C, the smaller the difference between the red, green, and blue light source luminances $I_{Rmax}$, $I_{Gmax}$, and $I_{Bmax}$. An example of the specific configuration of the operation is shown in the following Formula 17.

$$(I'_{Rmax}, I'_{Gmax}, I'_{Bmax}) = \begin{cases} (I_{max}, I_{max}, I_{max},) & L^* < T_{L^*} \vee C < T_C \\ (I_{Rmax}, I_{Gmax}, I_{Bmax}) & \text{otherwise} \end{cases} \quad \text{[Formula 17]}$$

As shown in the Formula 17, when the light source lightness L* and the light source chroma C are smaller than predetermined threshold values $T_L$* and $T_C$, it is determined that the lightness or chroma of the backlight 412 constituted of a plurality of colors of the light sources is small. In order to prevent the color change of the backlight 412, each of the red, green, and blue light source luminances is replaced with the light source maximum value $I_{max}$ to be converted to be the same as each other, that is, converted to be the achromatic color.

When the lightness L* is less than the threshold value $T_L$*, or when the chroma C is less than the threshold value $T_C$, the luminance correction is performed by the Formula 17, however, the luminance correction may be more accurately performed when the lightness and the chroma are less than their threshold values.

A variation of the luminance correction is shown as follows. First, the correction ratio β(L*) shown in FIG. 10 is calculated from the light source lightness L*. Further, the correction ratio χ(C) shown in FIG. 12 is calculated from the light source chroma C. The corrected light source luminances $I_{Rmax}$', $I_{Gmax}$', and $I_{Bmax}$' are calculated in accordance with the following Formula 18.

$$I'_{Rmax} = \begin{cases} \beta(L^*)\chi(C)\cdot I_{max} & \frac{I_{Rmax}}{I_{max}} < \beta(L^*)\chi(C) \\ I_{Rmax} & \text{otherwise} \end{cases} \quad \text{[Formula 18]}$$

$$I'_{Gmax} = \begin{cases} \beta(L^*)\chi(C)\cdot I_{max} & \frac{I_{Gmax}}{I_{max}} < \beta(L^*)\chi(C) \\ I_{Gmax} & \text{otherwise} \end{cases}$$

$$I'_{Bmax} = \begin{cases} \beta(L^*)\chi(C)\cdot I_{max} & \frac{I_{Bmax}}{I_{max}} < \beta(L^*)\chi(C) \\ I_{Bmax} & \text{otherwise} \end{cases}$$

The light source luminance correcting unit 403 outputs the red, green, and blue corrected light source luminances $I_{Rmax}$', $I_{Gmax}$', and $I_{Bmax}$', calculated as above, to the gradation conversion function calculating unit 404 and the control unit 405.

In the present embodiment, the lightness and the chroma in LCh color space coordinate are calculated, but other color space coordinates may be used. For example, when HSI color space coordinate is used, a lightness I and a chroma S are calculated by the following Formula 19.

$$I = \max(I_{Rmax}, I_{Gmax}, I_{Bmax}) \quad \text{[Formula 19]}$$

$$S = \begin{cases} 0 & I = 0 \\ \frac{(I - \min(I_{Rmax}, I_{Gmax}, I_{Bmax}))}{I} & \text{otherwise} \end{cases}$$

In Formula 19, $\max(x_0, x_1, x_2)$ is a function returning the maximum value of $x_0$, $x_1$, and $x_2$, and $\min(x_0, x_1, x_2)$ is a function returning the minimum value of $x_0$, $x_1$, and $x_2$.

When HSL color space coordinate is used, the lightness L and the chroma S are calculated by the following Formula 20.

$$L = \frac{\max(I_{Rmax}, I_{Gmax}, I_{Bmax}) + \min(I_{Rmax}, I_{Gmax}, I_{Bmax})}{2} \quad \text{[Formula 20]}$$

$$S = \begin{cases} 0 & L = 0 \\ \frac{\max(I_{Rmax}, I_{Gmax}, I_{Bmax}) - \min(I_{Rmax}, I_{Gmax}, I_{Bmax})}{\max(I_{Rmax}, I_{Gmax}, I_{Bmax}) + \min(I_{Rmax}, I_{Gmax}, I_{Bmax})} & L \le 0.5 \\ \frac{\max(I_{Rmax}, I_{Gmax}, I_{Bmax}) - \min(I_{Rmax}, I_{Gmax}, I_{Bmax})}{2 - \max(I_{Rmax}, I_{Gmax}, I_{Bmax}) - \min(I_{Rmax}, I_{Gmax}, I_{Bmax})} & L > 0.5 \end{cases}$$

The comparing result between the lightness and the threshold value is used in the correction of the light source luminance, whereby the human perception to luminance is considered. Further, the comparing result between the chroma and the threshold value is used in the correction of the light source luminance, whereby it is also considered that a human is sensitive to the change from achromatic color to chromatic color. Thus, in the present embodiment, although the processing amount is larger than that of the first to third embodiments, the light source luminance correction with higher accuracy can be realized.

In the present embodiment, the difference between the luminances of a plurality of colors is reduced in the low lightness and/or chroma, and the light source color approaches the achromatic color, whereby it is possible to prevent the color of the displayed image from being changed when the multicolor light source luminances of the backlight are controlled, and the visual contrast of the displayed image can be increased. At the same time, an image display device which can reduce the power consumption can be provided.

(Fifth Embodiment)

Figure 14:
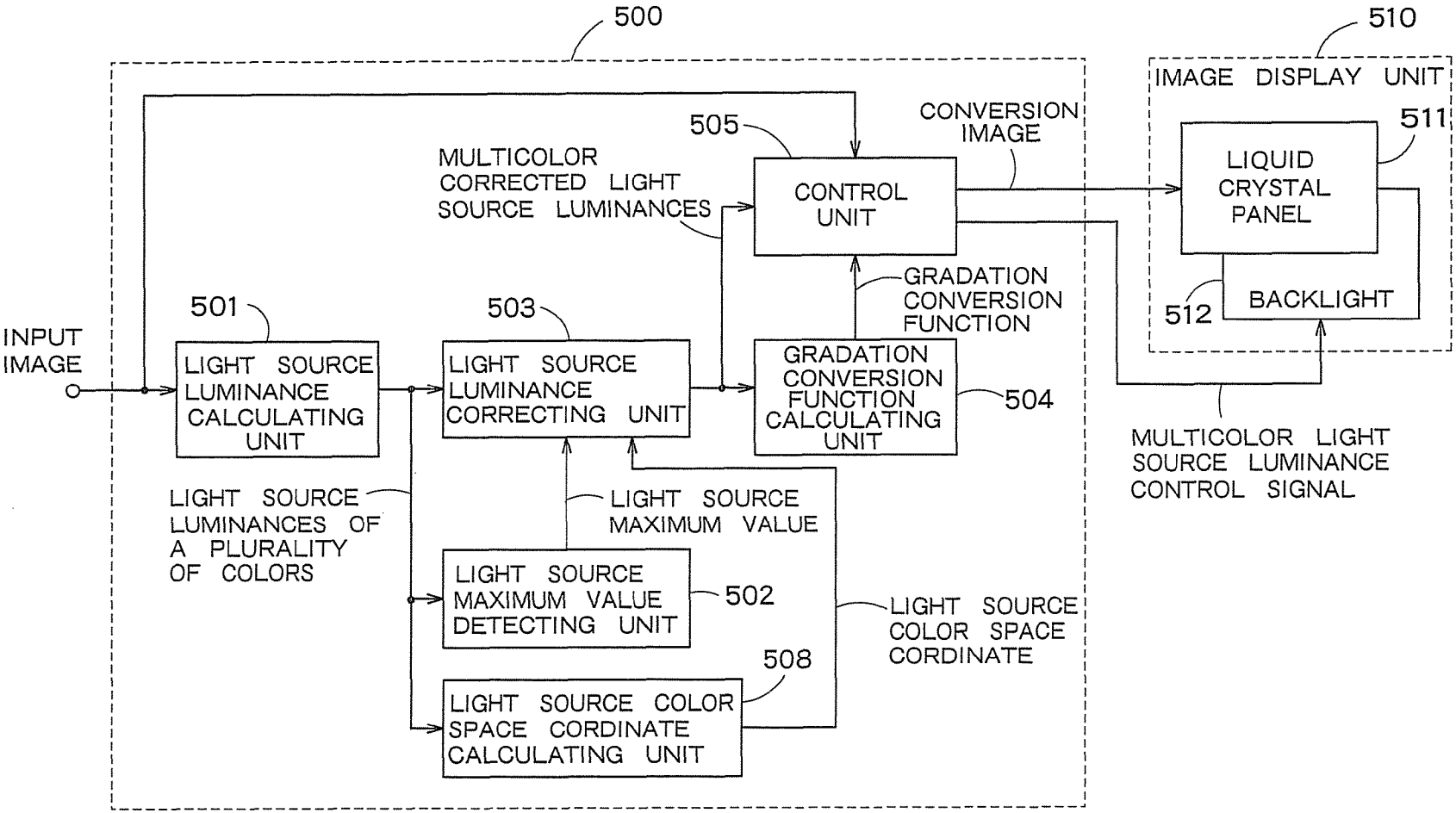
FIG. 14 is a schematic configuration diagram of an image processing apparatus according to a fifth embodiment.

FIG. 14 shows a schematic configuration of an image processing apparatus 500 according to the fifth embodiment of this invention. The image processing apparatus 500 comprises a light source luminance calculating unit 501, a light source maximum value detecting unit 502, a light source luminance correcting unit 503, a gradation conversion function calculating unit 504, a control unit 505, and a light source color space coordinate calculating unit 508. The image processing apparatus 500 performs image display control of an image display unit 510.

The image display unit 510 is a liquid crystal display unit having a liquid crystal panel 511, which is a light modulation device and a backlight 512 which is a plurality of colors of a light source unit provided on the back surface of the liquid crystal panel 511.

The light source luminance calculating unit 501, the light source maximum value detecting unit 502, the gradation conversion function calculating unit 504, the control unit 505, and the image display unit 510 are similar to the light source luminance calculating unit 101, the light source maximum value detecting unit 102, the gradation conversion function calculating unit 104, the control unit 105, and the image display unit 110 of the first embodiment, and thus the description will be omitted.

The light source color space coordinate calculating unit 508 calculates the color space coordinate from the multicolor light source luminances calculated by the light source luminance calculating unit 501.

For example when a plurality of colors of the light sources of the backlight 512 can emit red, green, and blue lights, the light source color space coordinate calculating unit 508 calculates tristimulus values X, Y, Z of the light source by the following Formula 21 with the use of the red, green, and blue light source luminances $I_{Rmax}$, $I_{Gmax}$, and $I_{Bmax}$ having a value from 0 (minimum) to 1 (maximum) set by the light source luminance calculating unit 501.

$$\begin{bmatrix} X \\ Y \\ Z \end{bmatrix} = M \begin{bmatrix} I_{Rmax} \\ I_{Gmax} \\ I_{Bmax} \end{bmatrix} \quad \text{[Formula 21]}$$

In Formula 21, $I_{Rmax}$, $I_{Gmax}$, and $I_{Bmax}$ are respectively the red, green, and blue light source luminances represented by 0 to 1, and M is a matrix of 3×3 determined by the red, green, and blue spectral characteristics. M is normalized so that when $I_{Rmax}$, $I_{Gmax}$, and $I_{Bmax}$ are maximum, that is, all of them are 1, Y is 1. Next, the light source color space coordinate calculating unit 508 calculates a color space coordinate L*, a*, and b* by the following Formula 22 with the use of the tristimulus values X, Y, and Z.

$$\begin{aligned} L^* &= 116 f(Y/Y_W) - 16 \\ a^* &= 500\{f(X/X_W) - f(Y/Y_W)\} \\ b^* &= 200\{f(Y/Y_W) - f(Z/Z_W)\} \end{aligned} \quad \text{[Formula 22]}$$

In Formula 22, $X_W$, $Y_W$, and $Z_W$ represent the tristimulus values when $I_{Rmax}$, $I_{Gmax}$, and $I_{Bmax}$ are maximum, that is, all of them are 1. The function f(x) is represented as the following Formula 23.

$$f(x) = \begin{cases} x^{1/3} \\ 7.787x + 16/116 \end{cases} \quad \text{[Formula 23]}$$

L*, a*, and b* calculated by the Formula 22 are a color space using a three-dimensional orthogonal coordinate system called the CIELAB color space.

In the present embodiment, although the color space coordinate in the CIELAB color space is calculated, there are various methods of calculating the color space coordinate, and the color space coordinate may be calculated in, for example, CIELUV color space. The color space coordinate L*, u*, and v* of the CIELUV color space are calculated by the following Formula 24.

$$\begin{aligned} L^* &= 116(Y/Y_W) - 16 \\ u^* &= 13L^*(u' - u_W') \\ v^* &= 13L^*(v' - v_W') \end{aligned} \quad \text{[Formula 24]}$$

u', v' and $u_W$40 , $v_W$' are calculated by the following Formula 25.

$$\begin{aligned} u' &= \frac{4X}{X + 15Y + 3Z} \\ v' &= \frac{9Y}{X + 15Y + 3Z} \\ u'_W &= \frac{4X_W}{X_W + 15Y_W + 3Z_W} \\ v'_W &= \frac{9Y}{X_W + 15Y_W + 3Z_W} \end{aligned} \quad \text{[Formula 25]}$$

The light source color space coordinate calculating unit 508 outputs, as a light source color space coordinate, the color space coordinate, calculated as above, to the light source luminance correcting unit 503.

The light source luminance correcting unit 503 corrects the red, green, and blue light source luminances, calculated by the light source luminance calculating unit 501, based on the light source color space coordinate and calculates the multicolor corrected light source luminances.

The light source luminance correcting unit 503 performs correction so that the smaller the multicolor light source color space coordinate L*, a*, and b*, the smaller the difference between the red, green, and blue light source luminances $I_{Rmax}$, $I_{Gmax}$, and $I_{Bmax}$. An example of the specific configuration of the operation is shown in the following Formula 26.

$$(l'_{Rmax}, l'_{Gmax}, l'_{Bmax}) = \begin{cases} (l_{max}, l_{max}, l_{max},) & L^* < T_{L^*} \vee a^* < T_{a^*} \vee b^* < T_{b^*} \\ (l_{Rmax}, l_{Gmax}, l_{Bmax}) & \text{otherwise} \end{cases} \quad \text{[Formula 26]}$$

As shown in the Formula 26, when the multicolor light source color space coordinate L*, a*, and b* is smaller than predetermined threshold values $T_L$*, $T_a$*, and $T_b$*, it is determined that the lightness or chroma of the backlight 512 constituted of a plurality of colors of the light sources is small. In order to prevent the color change of the backlight 512, each of the red, green, and blue light source luminances is replaced with the light source maximum value $I_{max}$ to be converted to be the same as each other, that is, converted to be the achromatic color.

In the Formula 26, when L* is less than the threshold value $T_L$*, when a* is less than the threshold value $T_a$*, or when b* is less than the threshold value $T_b$*, the correction is performed; however, the correction may be more accurately performed when L*, a*, and b* are less than the respective threshold values.

Figure 15:
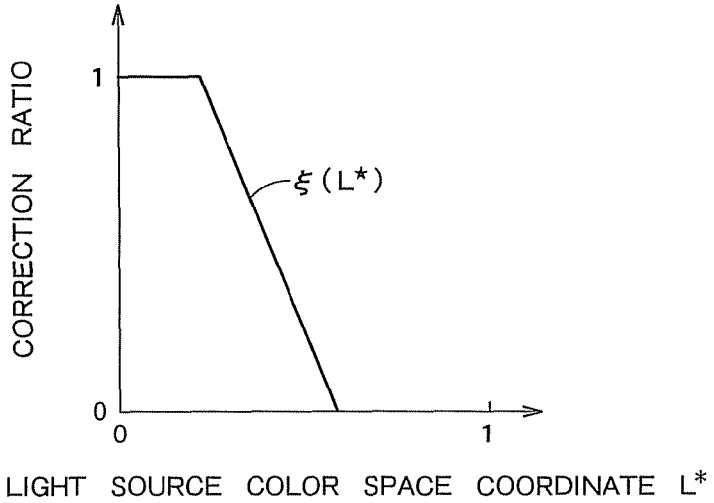
FIG. 15 is a graph showing a relation between a color space coordinate and the correction ratio.
Figure 16:
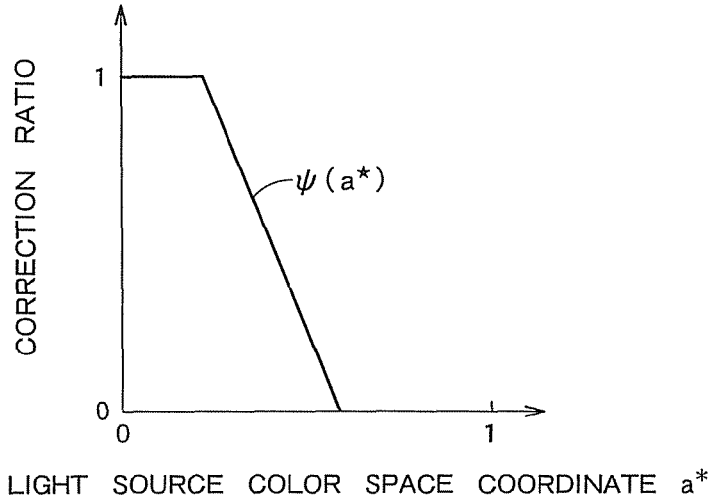
FIG. 16 is a graph showing a relation between a color space coordinate and the correction ratio.
Figure 17:
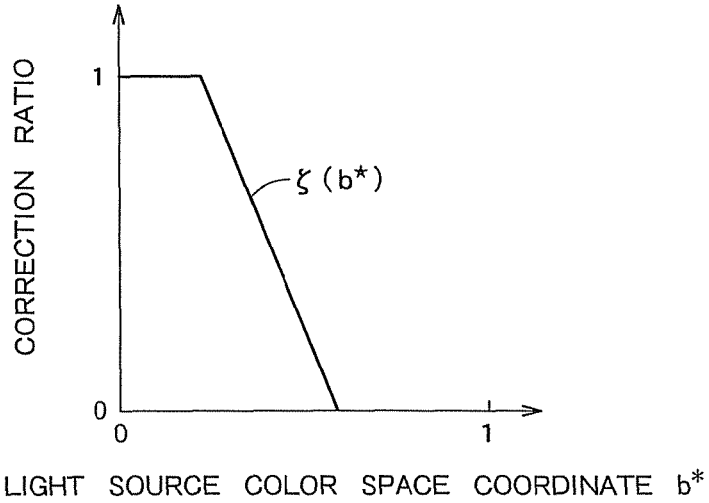
FIG. 17 is a graph showing a relation between a color space coordinate and the correction ratio.

A variation of the correcting method is described. First, correction ratios ξ(L*), ψ(a*), and ζ(b*) are calculated from the functions shown in FIGS. 15 to 17 with the use of the light source color space coordinate L*, a*, and b*. The light source luminances are corrected in accordance with the following Formula 27, whereby the multicolor corrected light source luminances are calculated.

$$l'_{Rmax} = \begin{cases} \xi(L^*)\psi(a^*)\zeta(b^*)\cdot l_{max} & \frac{l_{Rmax}}{l_{max}} < \xi(L^*)\psi(a^*)\zeta(b^*) \\ l_{Rmax} & \text{otherwise} \end{cases} \quad \text{[Formula 27]}$$

$$l'_{Gmax} = \begin{cases} \xi(L^*)\psi(a^*)\zeta(b^*)\cdot l_{max} & \frac{l_{Gmax}}{l_{max}} < \xi(L^*)\psi(a^*)\zeta(b^*) \\ l_{Gmax} & \text{otherwise} \end{cases}$$

$$l'_{Bmax} = \begin{cases} \xi(L^*)\psi(a^*)\zeta(b^*)\cdot l_{max} & \frac{l_{Bmax}}{l_{max}} < \xi(L^*)\psi(a^*)\zeta(b^*) \\ l_{Bmax} & \text{otherwise} \end{cases}$$

The light source luminance correcting unit 503 outputs the red, green, and blue multicolor corrected light source luminances $I_{Rmax}$', $I_{Gmax}$', and $I_{Bmax}$', calculated as above, to the gradation conversion function calculating unit 504 and the control unit 505.

According to the present embodiment, the difference between the luminances of a plurality of colors is reduced in the low color space coordinate, and the light source color approaches the achromatic color, whereby it is possible to prevent the color of the displayed image from being changed when the multicolor light source luminances of the backlight is controlled, and the visual contrast of the displayed image can be increased. At the same time, an image display device which can reduce the power consumption can be provided.

The light source color space coordinate calculating unit 508 may calculate the coordinate in any one of the color spaces of CIELAB, CIELUV, LCh, HSI, and HSL.

(Sixth Embodiment)

Figure 18:
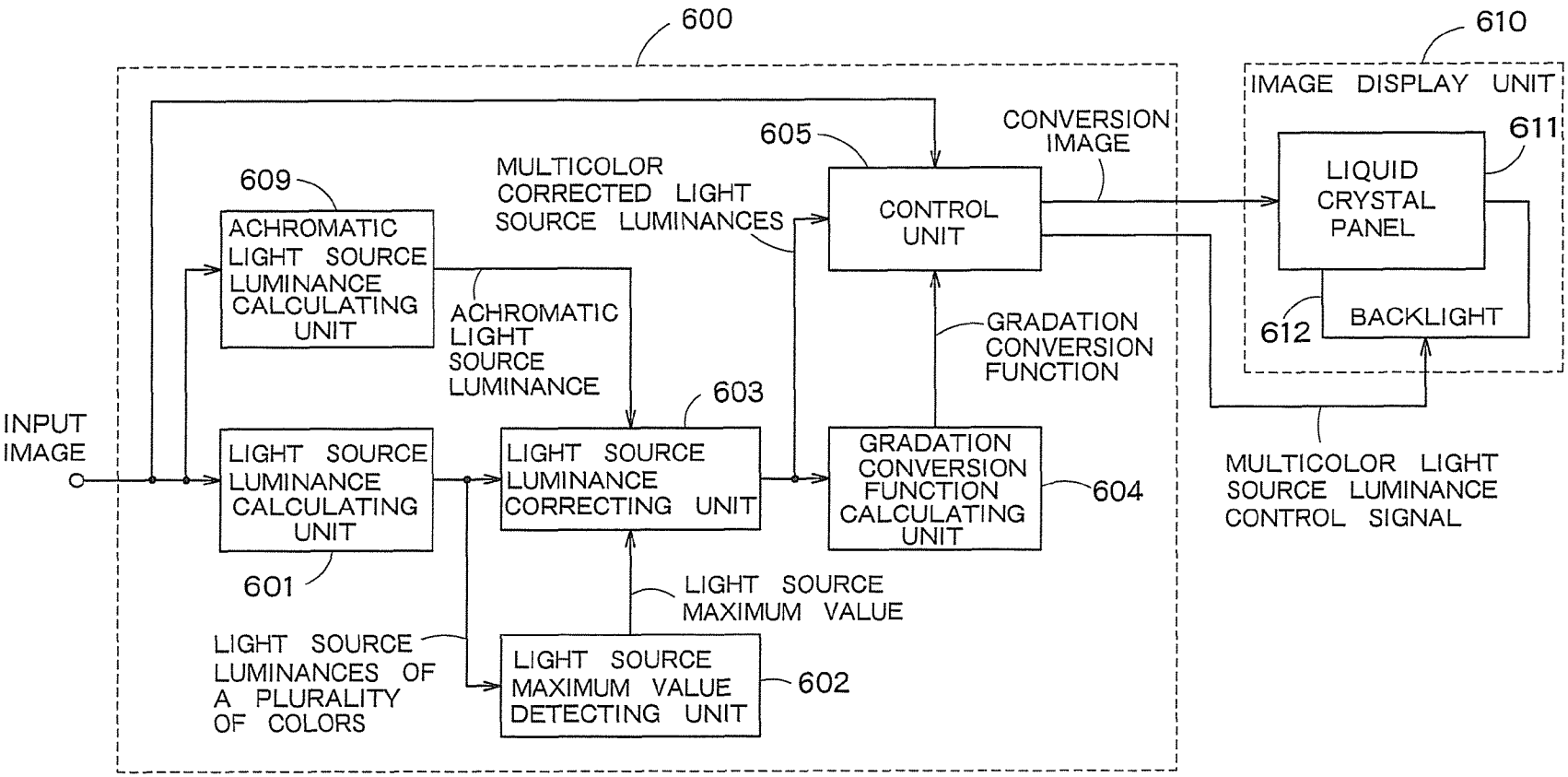
FIG. 18 is a schematic configuration diagram of an image processing apparatus according to a sixth embodiment.

FIG. 18 shows a schematic configuration of an image processing apparatus 600 according to the sixth embodiment of this invention. The image processing apparatus 600 comprises a light source luminance calculating unit 601, a light source maximum value detecting unit 602, a light source luminance correcting unit 603, a gradation conversion function calculating unit 604, a control unit 605, and an achromatic light source luminance calculating unit 609. The image processing apparatus 600 performs image display control of an image display unit 610.

The image display unit 610 is a liquid crystal display unit having a liquid crystal panel 611, which is a light modulation device and a backlight 612 which is a plurality of colors of a light source unit provided on the back surface of the liquid crystal panel 611.

The light source luminance calculating unit 601, the light source maximum value detecting unit 602, the gradation conversion function calculating unit 604, the control unit 605, and the image display unit 610 are similar to the light source luminance calculating unit 101, the light source maximum value detecting unit 102, the gradation conversion function calculating unit 104, the control unit 105, and the image display unit 110 of the first embodiment, and thus the description will be omitted.

The achromatic light source luminance calculating unit 609 calculates the light source luminance supposing that the light source has an achromatic color, that is, a white light source.

Although, according to the input image, there are considered various methods of calculating the achromatic light source luminance, the present embodiment provides a constitution that the maximum gradation is detected from an input image without discrimination of red, blue, and green sub pixels, and a value obtained by conversion from the maximum gradation to the maximum luminance is set to the achromatic light source luminance.

For example, in an image with the input image expressed by 8 bits (0 gradation to 255 gradation), an achromatic maximum luminance $I_{Wmax}$, that is, the achromatic light source luminance can be analytically calculated from an achromatic maximum gradation $L_{Wmax}$ by the following Formula 28.

$$l_{Wmax} = \left(\frac{L_{Wmax}}{255}\right)^{\gamma} \quad \text{[Formula 28]}$$

The achromatic light source luminance calculating unit 609 outputs the achromatic light source luminance, calculated as above, to the light source luminance correcting unit 603.

The light source luminance correcting unit 603 calculates the multicolor corrected light source luminance from the achromatic light source luminance and a weighted mean between the red, green, and blue light source luminances, calculated by a multicolor corrected light source luminance calculating unit, based on the light source maximum value $I_{max}$ calculated by the light source maximum value detecting unit 602.

The light source luminance correcting unit 603 calculates the multicolor corrected light source luminances $I_{Rmax}$', $I_{Gmax}$', and $I_{Bmax}$', by a weighted linear sum, such as the following Formula 29, with the use of the achromatic light source luminance $I_{Wmax}$ and the red, green, and blue light source luminances $I_{Rmax}$, $I_{Gmax}$ and $I_{Bmax}$.

$$l_{Rmax}' = \tau(l_{max})\cdot l_{Wmax} + (1-\tau(l_{max}))\cdot l_{Rmax}$$

$$l_{Gmax}' = \tau(l_{max})\cdot l_{Wmax} + (1-\tau(l_{max}))\cdot l_{Gmax}$$

$$l_{Bmax}' = \tau(l_{max})\cdot l_{Wmax} + (1-\tau(l_{max})\mathbf{19}\ l_{Bmax} \quad \text{[Formula 29]}$$

Figure 19:
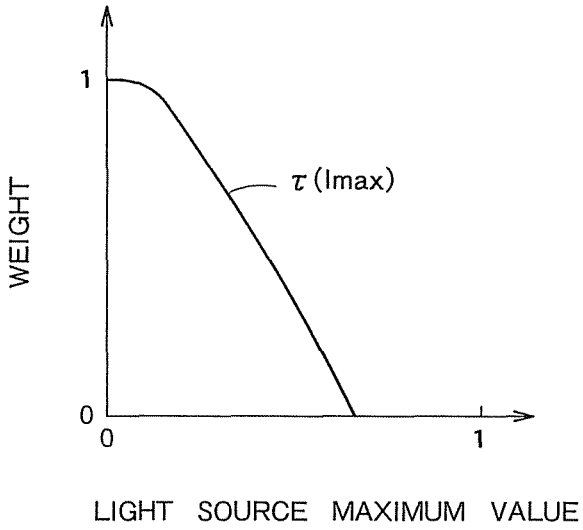
FIG. 19 is a graph showing a relation between the light source maximum value and a weight of an achromatic light source luminance.

In Formula 29, $\tau(I_{max})$ represents the weight of the achromatic light source luminance $I_{Wmax}$ and the weights of the red, green, and blue light source luminances, and a value from 0 to 1. Namely, when the weight $\tau(I_{max})$ is 1, the achromatic light source luminance $I_{Wmax}$ is set as the multicolor corrected light source luminance, and therefore, the light source is an achromatic color. When the weight $\tau(I_{max})$ is 0, the red, green, and blue light source luminances set by the light source luminance calculating unit 601 are calculated, as it is, as the multicolor corrected light source luminances. For example, the weighting function $\tau(I_{max})$ may be a function monotonically decreasing to the light source maximum value $I_{max}$ shown in FIG. 19.

The light source luminance correcting unit 603 outputs the red, green, and blue multicolor corrected light source luminances $I_{Rmax}'$, $I_{Gmax}'$, and $I_{Bmax}'$, calculated as above, to the gradation conversion function calculating unit 604 and the control unit 605.

According to the present embodiment, the light source luminance of each color is corrected by using the achromatic light source luminance, and therefore, it is possible to prevent the color of the displayed image from being changed when the multicolor light source luminances of the backlight are controlled, and the visual contrast of the displayed image can be increased. At the same time, an image display device which can reduce the power consumption can be provided.

(Seventh Embodiment)

Figure 20:
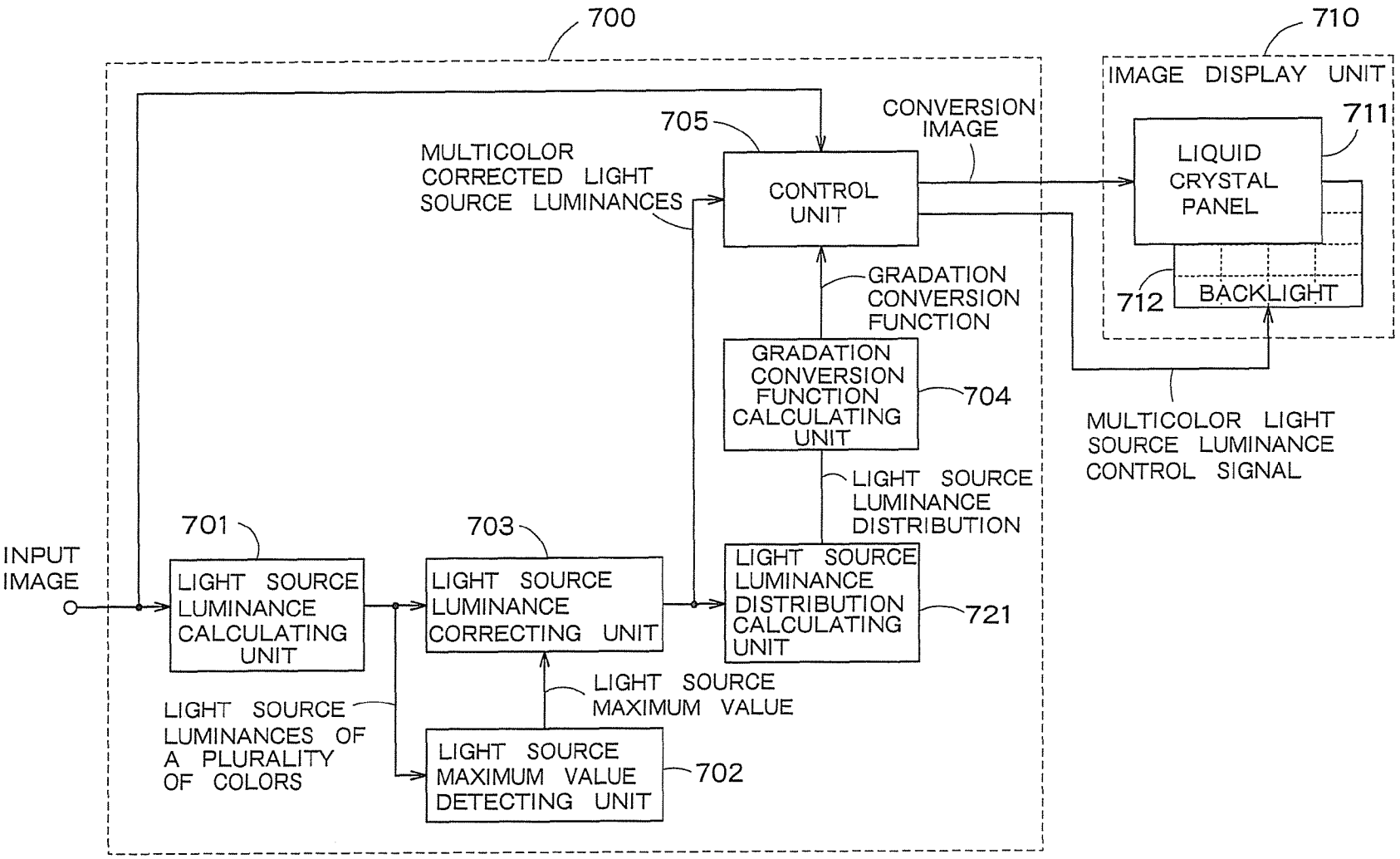
FIG. 20 is a schematic configuration diagram of an image processing apparatus according to a seventh embodiment.

FIG. 20 shows a schematic configuration of an image display device comprising an image processing apparatus 700 and an image display unit 710 according to the seventh embodiment of this invention. The image processing apparatus 700 comprises a light source luminance calculating unit 701, a light source maximum value detecting unit 702, a light source luminance correcting unit 703, a gradation conversion function calculating unit 704, a control unit 705, and a light source luminance distribution calculating unit 721.

The image processing apparatus 700 performs image display control of an image display unit 710. The image display unit 710 is a liquid crystal display unit having a liquid crystal panel 711, which is a light modulation device, and a backlight 712 which is a plurality of colors of a light source unit provided on the back surface of the liquid crystal panel 711. The backlight 712 can bed modulated in luminance for each of a plurality of divisional regions.

The light source luminance calculating unit 701 calculates a plurality of colors of the light source luminances of the backlight 712 from an input image. In the first embodiment, the red, green, and blue maximum gradations are detected from the entire input image, and the light source luminance of each color is calculated based on the maximum gradation. However, in the present embodiment, the red, green, and blue maximum gradations are detected for each region of the input image corresponding to each region of the backlight 712, which can be modulated in luminance for each region, and the light source luminance of each color of each region of the backlight is calculated based on the maximum gradation.

Figure 21:
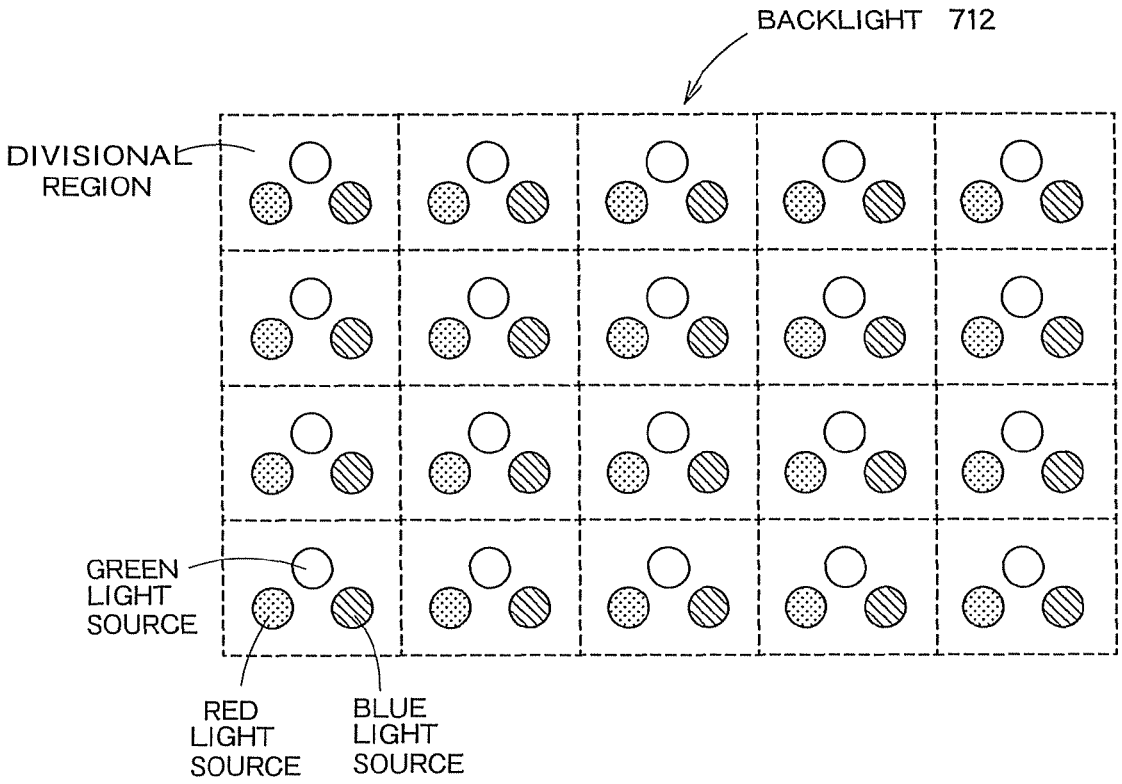
FIG. 21 is a view showing an example of regional division of a backlight.

For example, as shown in FIG. 21, in a backlight configuration in which five divisional regions are provided in a horizontal direction, and four divisional regions are provided in a vertical direction, the input image is divided into 5×4 regions so as to correspond to each divisional region, and the multicolor light source luminances of the input image are calculated for each divisional region as in the first embodiment.

In the present embodiment, although one divisional region includes a pair of red, green, and blue light sources, for example, one divisional region may include a plurality of pairs of red, green, and blue light sources.

In FIG. 21, the input image is evenly divided to obtain the divisional regions; however, the multicolor light source luminances may be calculated in a state that the divisional regions unitially overlap each other.

The light source luminance calculating unit 701 outputs the multicolor light source luminances of each divisional region, calculated as above, to the light source maximum value detecting unit 702 and the light source luminance correcting unit 703.

The light source maximum value detecting unit 702 detects the maximum value of the red, green, and blue light source luminances, which are a plurality of colors of the light sources of the backlight 712, for each divisional region of the backlight 712. Namely, the light source maximum value detecting unit 702 compares the red, green, and blue light source luminances for each divisional region, calculated by the light source luminance calculating unit 701, to detect the maximum value of the red, green, and blue light source luminances. The light source maximum value detecting unit 702 then outputs the detected maximum value of the light source luminance in each divisional region, which is the light source maximum value of each divisional region, to the light source luminance correcting unit 703.

The light source luminance correcting unit 703 corrects the red, green, and blue light source luminances in each divisional region of the backlight 712, calculated by the light source luminance calculating unit 701, based on the light source maximum value in each divisional region and calculates the multicolor corrected light source luminances in each divisional region. The method of correcting the multicolor corrected light source luminances in each divisional region is similar to the first embodiment, and the threshold value processing shown in the formula 2 or 3 may be performed for each divisional region.

The light source luminance correcting unit 703 outputs the calculated multicolor corrected light source luminances in each divisional region to the light source luminance distribution calculating unit 721 and the control unit 705.

The light source luminance distribution calculating unit 721 calculates the actual luminance distribution of the backlight 712 based on the multicolor corrected light source luminances in each divisional region.

Figure 22:
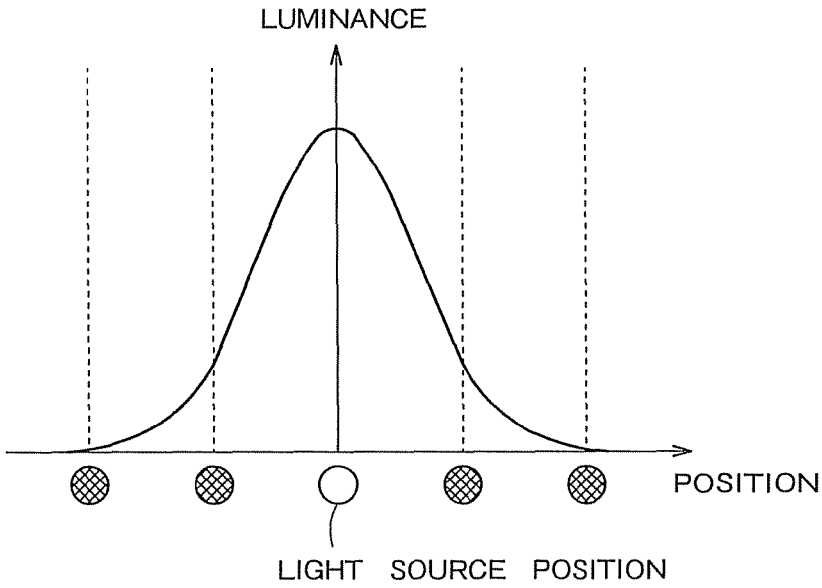
FIG. 22 is a graph showing luminance distribution when one light source emits light.

FIG. 22 shows the luminance distribution when one of a plurality of colors of the light sources in one divisional region of the backlight emits light. In FIG. 22, for ease of explanation, the luminance distribution is expressed one-dimensionally, and the horizontal axis represents a position, and the vertical axis represents a luminance. FIG. 22 shows the luminance distribution when only one light source at the center is turned on.

As shown in FIG. 22, the luminance distribution at the time when a certain light source emits light spreads to the adjacent light source position. Therefore, in order to perform the gradation conversion based on the backlight luminance in the control unit 705, the emission luminance distributions shown in FIG. 22 are added together based on the corrected light source luminances of the light sources of a plurality of colors in each region of the backlight 712, whereby the actual luminance distribution of the backlight is calculated.

Figure 23:
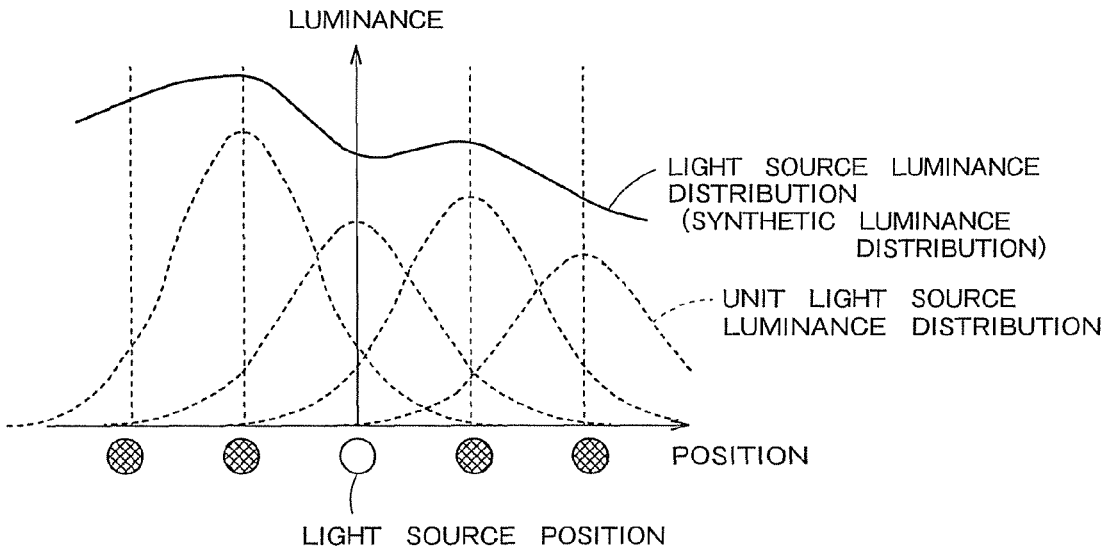
FIG. 23 is a graph showing the luminance distribution when a plurality of light sources emit light.

FIG. 23 schematically shows the backlight luminance distribution when a plurality of light sources is turned on in one divisional region in the backlight 712. In FIG. 23, for ease of explanation, the luminance distribution is expressed one-dimensionally. The unit light source luminance distributions based on the turning on of each light source are shown by the dashed lines in FIG. 23. These unit light source luminance distributions are added together, whereby the light source luminance distribution shown by the solid line of FIG. 23 is calculated.

The emission luminance distribution of the light source shown in FIG. 22 may be calculated from an approximate function, associated with an actual measured value and a distance from the light source, to be held in the light source luminance distribution calculating unit 721; however, in the present embodiment, a relation between the distance from the light source and the luminance is previously obtained to be held as an LUT (lookup table) in ROM.

Figure 24:
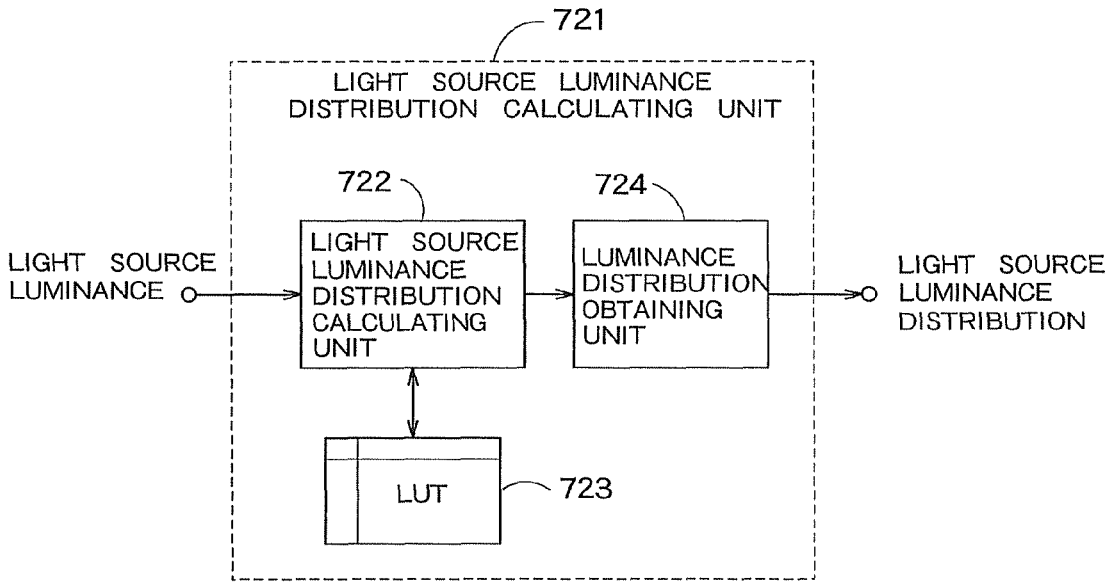
FIG. 24 is a schematic configuration diagram of a light source luminance distribution calculating unit according to the seventh embodiment.

FIG. 24 shows a configuration of the light source luminance distribution calculating unit 721. The multicolor corrected light source luminances calculated for each divisional region are input to a luminance distribution obtaining unit 722. The luminance distribution obtaining unit 722 obtains the luminance distribution of each light source from an LUT 723 to multiply together the multicolor corrected light source luminances, and, thus, to obtain the unit light source luminance distributions of each light source in each divisional region shown in the dashed lines in FIG. 23.

A luminance distribution synthesizing unit 724 adds together the unit light source luminance distributions corresponding to each light source in each divisional region obtained by the luminance distribution obtaining unit 722 and calculates a synthetic luminance distribution (light source luminance distribution) shown by the solid line in FIG. 23.

The, light source luminance distribution (synthetic luminance distribution) in each divisional region calculated by the light source luminance distribution calculating unit 721 (the luminance distribution synthesizing unit 724) is output to the gradation conversion function calculating unit 704.

The gradation conversion function calculating unit 704 calculates, from the red, green, and blue multicolor light source luminance distributions, the gradation conversion functions (gains) converting the red, green, and blue images of the input image.

Although the basic configuration of the gradation conversion function calculating unit 704 is similar to the gradation conversion function calculating unit 104 of the first embodiment, the multicolor corrected light source luminances are different for each position (divisional region) of the input image. Therefore, the Formula 4 is replaced with the following Formula 30.

$$(G_R(x, y), G_G(x, y), G_B(x, y)) = \left(\frac{1}{d_{Rmax}(x, y)}, \frac{1}{d_{Gmax}(x, y)}, \frac{1}{d_{Bmax}(x, y)}\right) \quad \text{[Formula 30]}$$

In Formula 30, $d_{Rmax}(x, y)$, $d_{Gmax}(x, y)$, and $d_{Bmax}(x, y)$ respectively represent the red, green, and blue light source luminance distributions at the horizontal pixel position x and the vertical pixel position y of an image, and $G_R(x, y)$, $G_G(x, y)$, and $G_B(x, y)$ represent the gains given to the image at the position (x, y).

As in the first embodiment, the relation of the light source luminance and the gain may be held as a lookup table in, for example, ROM to be referred.

The gradation conversion function calculating unit 704 outputs the gains applied to the red, green, and blue images in each divisional region of the input image, calculated by the above processing, to the control unit 705.

The control unit 705 uses the gradation conversion function, set by the gradation conversion function calculating unit 704, in the input image to generate a conversion image. The control unit 705 further generates, from the multicolor corrected light source luminances, the multicolor corrected light source luminance control signal for making a plurality of colors of the light sources of the backlight 712 actually emit light.

The control unit 705 controls a timing to output the conversion image to the liquid crystal panel 711 and outputs the multicolor light source control signal to a plurality of colors of the light sources of the backlight 712.

In the present embodiment, although the basic constitution of the gradation conversion method is similar to the first embodiment, the gain is different for each position (divisional region) of the input image. Therefore, the Formula 5 is replaced with the following Formula 31.

$$L_{Rout}(x, y)=G_R(x, y)^{1/\gamma}\cdot L_{Rin}(x, y)$$

$$L_{Gout}(x, y)=G_G(x, Y)^{1/\gamma}\cdot L_{Gin}(x, y)$$

$$L_{Bout}(x, y)=G_B(x, y)^{1/\gamma}\cdot L_{Bin}(x, y) \quad \text{[Formula 31]}$$

The control unit 705 converts the input image by using the Formula 31 and calculates the conversion image.

Although the basic configuration of the multicolor corrected light source luminance control signal is similar to the first embodiment, the multicolor corrected light source luminance control signal is output for each divisional region of the backlight 712.

In the present embodiment, as in the first embodiment, the LED light source is used as the light source of the backlight, and the LED light source is luminance-modulated by the PWM control. Thus, the control unit 705 generates the PWM control signal to a plurality of colors of the light sources in each divisional region, based on the multicolor corrected light source luminances of each divisional region of the backlight 712 and sends the PWM control signal, which is the multicolor corrected light source luminance control signal, to the backlight 712.

In the image display unit 710, the conversion image output from the control unit 705 is written in the liquid crystal panel (light modulation device) 711, and the backlight 712 is turned on based on the multicolor corrected light source luminance control signal in each divisional region output from the control unit 705, whereby the input image is displayed.

According to the present embodiment, the difference between the luminances of a plurality of colors is reduced for each divisional region in the low luminance, and the light source color approaches the achromatic color, whereby it is possible to prevent the color of the displayed image from being changed when a plurality of colors of the light source luminances of the backlight are controlled, and the visual contrast of the displayed image can be increased. At the same time, the power consumption can be reduced.

Further, the luminance distributions of each light source are added together in each divisional region, and each gain applied to the red, green, and blue images is calculated, whereby the visual contrast of the displayed image can be further increased.

In the above embodiments, a transmissive liquid crystal display device with the combination of a liquid crystal panel and a backlight has been described as an example of the image display unit; however, the above embodiments are applicable to configurations of various image display units other than the transmissive liquid crystal display device.

For example, the above embodiments are applicable to a projection type image display unit with the combination of a liquid crystal pane as a light modulation device and a light source such as a halogen light source. Further, there may be used a projection type image display unit using a halogen light source as a light source unit and a digital micromirror device, which is used as the light modulation device and displays an image by controlling reflection of the light from the halogen light source.

The function of each block shown in FIGS. 1, 9, 11, 13, 14, 18, 20, and 24 can be also realized by processing by a computer described as software and having a suitable mechanism.

The above embodiments can be also practiced as a program for making a computer execute a predetermined procedure, for making a computer function as predetermined means, or for making a computer realize a predetermined function. Further, the embodiments can be practiced as a computer-readable recording medium recorded with the program. The recording medium is not limited to a detachable recording medium such as a magnetic disk and an optical disk, but may be a fixed type recording medium such as a hard disk device and a memory.

The program may be distributed through a communication line (including wireless communication) such as internet. Further, in such a state that the program is encrypted, modulated, or compressed, the program may be distributed through a wired line such as internet or a wireless line or may be contained in the recording medium and distributed.

In the above embodiments, although the light source luminance of the backlight is calculated based on the maximum luminance of the input image, it may be calculated based on the average value of the input image.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for processing image to supply a luminance control signal to light sources corresponding to a plurality of colors, and to supply a conversion image to a light modulation device which modulates a transmittance or a reflectance of lights emitted from the light sources, comprising:

a luminance calculating unit configured to calculate luminances of the light sources by using an input image;

a maximum value detecting unit configured to detect a maximum value that is the largest value in the luminances of the light sources of the plurality of colors;

a luminance correcting unit configured to correct the luminances of the light sources to obtain corrected luminances of the light sources so as to reduce a difference among the luminances of the light sources of the plurality of colors, if the maximum value is smaller than a predetermined threshold value;

a function calculating unit configured to calculate a gradation conversion function applied to the input image corresponding to each of the plurality of colors, by using the corrected luminances of the light sources; and a control unit configured to convert the input image into the conversion image by using the gradation conversion function, configured to supply the conversion image to the modulation device, and configured to generate the luminance control signal by using the corrected luminance of the light sources, wherein the predetermined threshold value is smaller than a half of a maximum allowable value for the luminances of the light sources.

2. The apparatus according to claim 1, wherein the luminance correcting unit corrects the luminance of the light sources so that the smaller the maximum value, the smaller a difference between the luminance of each of the plurality of colors and the maximum value.

3. The apparatus according to claim 1, wherein when the maximum value is smaller than the predetermined threshold value, the luminance correcting unit replaces the luminance of each of the plurality of colors with the maximum value.

4. The apparatus according to claim 1, wherein the function calculating unit calculates inverse of the corrected luminance of the light sources as the gradation conversion function.

5. The apparatus according to claim 1, further comprising a lightness calculating unit which calculates the lightness by using the luminance of each of the plurality of colors, wherein the luminance correcting unit corrects the luminances to obtain the corrected luminances so as to reduce the difference among the luminances of the plurality of colors, if the lightness is smaller than a predetermined threshold value.

6. The apparatus according to claim 1, further comprising a chroma calculating unit which calculates a chroma by using the luminance of each of the plurality of colors, wherein the luminance correcting unit corrects the luminances to obtain the corrected luminances so as to reduce the difference among the luminances of the plurality of colors, if the chroma is smaller than a predetermined threshold value.

7. The apparatus according to claim 5, further comprising a chroma calculating unit which calculates the chroma by using the luminance of each of the plurality of colors, wherein the luminance correcting unit corrects the luminance to obtain the corrected luminances so as to reduce the difference among the luminances of the plurality of colors, if the lightness is smaller than a first threshold value and/or the chroma is smaller than a second threshold value.

8. The apparatus according to claim 5, wherein the lightness is the lightness in anyone of color spaces of CIELAB, CIELUV, LCh, HSI, and HSL.

9. The apparatus according to claim 6, wherein the chroma is the chroma in anyone of color spaces of CIELAB, CIELUV, LCh, HSI, and HSL.

10. The apparatus according to claim 1, further comprising a color space coordinate calculating unit which calculates a color space coordinate by using the luminance of each of the plurality of colors, wherein the luminance correcting unit corrects the luminance to obtain the corrected luminances so as to reduce the difference among the luminances of the plurality of colors, if at least anyone of coordinate value of the color space coordinate is smaller than a predetermined threshold value.

11. The apparatus according to claim 10, wherein a color space from which a coordinate is calculated by the color space coordinate calculating unit is anyone of CIELB, CIELUV, LCh, HSI, and HSL.

12. The apparatus according to claim 1, further comprising an achromatic luminance calculating unit which calculates an achromatic luminance, which is the luminance supposing that the light source is an achromatic color, by using the input image, wherein the luminance correcting unit calculates the corrected light source luminance by a weighted linear sum of the luminance of each of the plurality of colors and the achromatic luminance so that the smaller the maximum value, the higher the ratio of the achromatic luminance.

13. An image processing method, which generates a luminance control signal supplied to light sources corresponding to a plurality of colors and a conversion image supplied to a light modulation device which modulates a transmittance or a reflectance of lights emitted from the light sources, comprising:

calculating luminances of light sources by using an input image;

detecting a maximum value that is the largest value in the luminances of the light sources of the plurality of colors;

correcting the luminance of the light sources to obtain corrected luminances of the light sources so as to reduce the difference among the luminances of the light sources of the plurality of colors, if the maximum value is smaller than a predetermined threshold value;

calculating a gradation conversion function applied to the input image corresponding to each of the plurality of colors, by using the corrected luminance of the light sources;

converting the input image into the conversion image by using the gradation conversion function; and generating the luminance control signal by using the corrected luminance of the light sources, wherein the predetermined threshold value is smaller than a half of a maximum allowable value for the luminances of the light sources.

14. An image display device comprising:

a backlight configured to comprise light sources corresponding to a plurality of colors and a plurality of divisional regions, and configured to modulate luminances of the light sources by using a luminance control signal;

a liquid crystal panel configured to modulate a transmittance or a reflectance of lights emitted from the light sources by using a conversion image;

a luminance calculating unit configured to calculate luminances of the light sources for each of the plurality of divisional regions by using an input image;

a maximum value detecting unit configured to detect a maximum value that is the largest value in the luminances of the light sources of the plurality of colors, for each of the plurality of divisional regions;

a luminance correcting unit configured to, for each of the plurality of divisional regions, correct the luminances of the light sources to obtain corrected luminances of the light sources so as to reduce the difference among the luminances of the light sources of the plurality of colors, if the maximum value is smaller than a predetermined threshold value;

a luminance distribution calculating unit configured to, for each of the plurality of divisional regions, calculate luminance distribution in the light sources by using the corrected luminances of the light sources;

a function calculating unit configured to, for each of the plurality of divisional regions, calculate a gradation conversion function applied to the input image corresponding to each of the plurality of colors, by using the luminance distribution; and a control unit configured to convert the input image into the conversion image by using the gradation conversion function in each divisional region, configured to supply the conversion image to the liquid crystal panel, and configured to generate the luminance control signal by using the corrected luminance of the light sources in each divisional region, wherein the predetermined threshold value is smaller than a half of a maximum allowable value for the luminances of the light sources.

15. The apparatus according to claim 1, wherein the predetermined threshold value is smaller than 0.4.

16. The method according to claim 13, wherein the predetermined threshold value is smaller than 0.4.

17. The device according to claim 14, wherein the predetermined threshold value is smaller than 0.4.

* * * * *